US009931640B2

(12) United States Patent
Yount et al.

(10) Patent No.: US 9,931,640 B2
(45) Date of Patent: Apr. 3, 2018

(54) MAGNETIC FILTER SYSTEMS AND METHODS

(71) Applicant: FilterMag International, Inc., Scottsdale, AZ (US)

(72) Inventors: Randy Yount, Scottsdale, AZ (US); Wayne Johnson, Phoenix, AZ (US)

(73) Assignee: FilterMag International, Inc., Scottsdale, AZ (US)

( * ) Notice: Subject to any disclaimer, the term of this patent is extended or adjusted under 35 U.S.C. 154(b) by 0 days.

(21) Appl. No.: 15/794,421

(22) Filed: Oct. 26, 2017

(65) Prior Publication Data

US 2018/0043371 A1 Feb. 15, 2018

Related U.S. Application Data

(63) Continuation of application No. 15/386,697, filed on Dec. 21, 2016, now Pat. No. 9,821,319, which is a continuation of application No. 14/793,880, filed on Jul. 8, 2015, now Pat. No. 9,527,089.

(60) Provisional application No. 62/023,553, filed on Jul. 11, 2014.

(51) Int. Cl.

| | |
|---|---|
| ***B03C 1/10*** | (2006.01) |
| ***B03C 1/14*** | (2006.01) |
| ***B03C 1/28*** | (2006.01) |
| ***B03C 1/033*** | (2006.01) |

(52) U.S. Cl.

CPC ..... *B03C 1/10* (2013.01); *B03C 1/0332* (2013.01); *B03C 1/14* (2013.01); *B03C 1/288* (2013.01); *B03C 2201/18* (2013.01); *B03C 2201/20* (2013.01); *B03C 2201/30* (2013.01)

(58) Field of Classification Search

CPC .. B03C 1/10; B03C 1/14; B03C 1/288; B03C 1/0332; B03C 2201/18; B03C 2201/20; B03C 2201/30

See application file for complete search history.

(56) References Cited

U.S. PATENT DOCUMENTS

| | | | |
|---|---|---|---|
| 5,556,540 | A | 9/1996 | Brunsting |
| 5,647,993 | A | 7/1997 | Karp |
| 5,817,233 | A | 10/1998 | Cooper |
| 6,514,415 | B2 | 2/2003 | Hatch |
| 9,527,089 | B2 | 12/2016 | Yount et al. |
| 9,821,319 | B2 | 11/2017 | Yount et al. |
| 2004/0245179 | A1 | 12/2004 | Elsegood |
| 2005/0098490 | A1 | 5/2005 | Elsegood |

(Continued)

FOREIGN PATENT DOCUMENTS

| | | |
|---|---|---|
| WO | WO2016007584 | 1/2016 |

OTHER PUBLICATIONS

PCT; International Preliminary Report on Patentability dated Jul. 8, 2015 in Application No. PCT/US2015/039489.

(Continued)

*Primary Examiner* — David A Reifsnyder

(74) *Attorney, Agent, or Firm* — Snell & Wilmer L.L.P.

(57) ABSTRACT

Magnetic filter systems may be constructed with various arrangements of permanent magnets, including but not limited to checkerboard and spiral arrangements. When coupled to a conventional filter, exemplary magnetic filter systems capture ferrous particulates against the outer wall of the conventional filter by magnetic attraction, thereby reducing the number of particulates in a fluid stream and improving the quality of the filtered fluid.

11 Claims, 19 Drawing Sheets

(56) References Cited

U.S. PATENT DOCUMENTS

| | | | |
|---|---|---|---|
| 2016/0008821 | A1 | 1/2016 | Yount et al. |
| 2017/0165679 | A1 | 6/2017 | Yount |

OTHER PUBLICATIONS

PCT; International Search Report and Written Opinion dated Sep. 22, 2015 in Application No. PCT/US2015/039489.
USPTO; Notice of Allowance dated Sep. 28, 2016 in U.S. Appl. No. 14/793,880.
USPTO; Non-Final Office Action dated Mar. 30, 2017 in U.S. Appl. No. 15/386,697.
USPTO; Notice of Allowance dated Sep. 28, 2017 in U.S. Appl. No. 15/386,697.

| Beta versus Axial Coverage and Particle Size | | | | | | | | |
|---|---|---|---|---|---|---|---|---|
| % Axial Coverage | Beta | | | | Efficiency (a) | | | |
| ISO Bin | 4 | 6 | 14 | 21 | 4 | 6 | 14 | 21 |
| 20% | 8.1 | 12.0 | 54.9 | 115.0 | 87.65% | 91.67% | 98.18% | 99.13% |
| 40.0% | 23.0 | 30.0 | 122.0 | 230.0 | 95.65% | 96.67% | 99.18% | 99.57% |
| 60.0% | 31.1 | 42.0 | 176.9 | 345.0 | 96.78% | 97.62% | 99.43% | 99.71% |
| 80.0% | 33.4 | 51.0 | 219.6 | 360.0 | 97.01% | 98.04% | 99.54% | 99.72% |
| 100.0% | 38.0 | 60.0 | 274.5 | 575.0 | 97.37% | 98.33% | 99.64% | 99.83% |

| | | | | | | | | | | | | | | | | |
|---|---|---|---|---|---|---|---|---|---|---|---|---|---|---|---|---|
| Volume | 57 liters | | | | | | | | | | | | | | | |
| Flow rate | 15.14 lpm | | | | | | | | | | | | | | | |
| Starting # | 1000 | | | | | | | | | | | | | | | |
| | | | | | | | | | | | | | | | | |
| | Time | 0.0 | 1.0 | 2.0 | 3.0 | 4.0 | 5.0 | 6.0 | 7.0 | 8.0 | 9.0 | 10.0 | 11.0 | 12.0 | 13.0 | 14.0 |
| 91.67% | 20% | 1000.0 | 783.90 | 614.49 | 481.70 | 377.60 | 296.00 | 232.03 | 181.89 | 142.58 | 111.77 | 87.62 | 68.682 | 53.839 | 42.204 | 33.084 |
| 96.67% | 40% | 1000.0 | 773.55 | 598.39 | 462.88 | 358.06 | 276.98 | 214.26 | 165.74 | 128.21 | 99.18 | 76.72 | 59.346 | 45.908 | 35.512 | 27.470 |
| 97.62% | 60% | 1000.0 | 771.60 | 595.37 | 459.38 | 354.46 | 273.50 | 211.03 | 162.83 | 125.64 | 96.95 | 74.80 | 57.718 | 44.535 | 34.363 | 26.515 |
| 98.04% | 80% | 1000.0 | 770.74 | 594.04 | 457.85 | 352.88 | 271.98 | 209.62 | 161.57 | 124.53 | 95.98 | 73.97 | 57.014 | 43.943 | 33.868 | 26.104 |
| 98.33% | 100% | 1000.0 | 770.14 | 593.11 | 456.78 | 351.78 | 270.92 | 208.64 | 160.68 | 123.75 | 95.30 | 73.40 | 56.526 | 43.533 | 33.526 | 25.820 |

FIG. 13

MAGNETIC FILTER SYSTEMS AND METHODS

CROSS REFERENCE TO RELATED APPLICATIONS

This application is a continuation of U.S. Ser. No. 15/386,697 filed on Dec. 21, 2016, now U.S. Pat. No. 9,821,319 entitled "MAGNETIC FILTER SYSTEMS AND METHODS". U.S. Ser. No. 15/386,697 is a continuation of U.S. Ser. No. 14/793,880 filed on Jul. 8, 2015, now' U.S. Pat. No. 9,527,089 entitled "MAGNETIC FILTER SYSTEMS AND METHODS". U.S. Ser. No. 14/793,880 claims priority to, and the benefit of, U.S. Provisional Application Ser. No. 62/023,553 entitled "MAGNETIC FILTER SYSTEMS AND METHODS" and filed Jul. 11, 2014. The entire contents of all the foregoing applications are incorporated herein by reference.

TECHNICAL FIELD

The present disclosure relates to filtering, and in particular to magnetic approaches for improved filtration of particulates.

BACKGROUND

Filtration devices, such as oil filters, are utilized on a wide variety of machinery, fluid delivery equipment, and the like. The filter is utilized to capture particulates, for example metal particulates arising from engine shedding. In this manner, wear is reduced, device lifetime is extended, fluid quality is improved, and so forth.

However, typical filters utilize a porous material with small openings. Particulates smaller than the porous material openings, for example smaller than about 20 microns, pass through the filter and remain in the fluid stream, where they can continue to cause damage and/or impair fluid quality. Additionally, decreasing filter pore size increases the power needed to pump a fluid. Attendant consequences can include: increased fluid heating, increased cost of fluid system to generate and contain the pressure, and increased charge production in the fluid as it flows through the filter element. Accordingly, improved filtration approaches and systems are desirable, particularly filtration approaches capable of filtering particulates of sizes smaller than the size of openings in porous filter materials.

SUMMARY

In an exemplary embodiment, a magnetic filter assembly comprises a structural frame having a mounting cavity, a flux return plate disposed within the mounting cavity, and a plurality of permanent magnets mounted against the flux return plate within the mounting cavity and forming the shape of a partial cylinder. The plurality of permanent magnets are oriented such that a magnetic axis of each permanent magnet is perpendicular to the flux return plate, and arranged in an array such that each magnet in the array is adjacent another magnet of opposite polarity. Each magnet of the plurality of permanent magnets is characterized by a magnet length dimensioned along the longitudinal axis of the partial cylinder, a magnet inner width dimensioned along the circular arc of the partial cylinder, and a magnet height dimensioned parallel to the magnetic axis of each permanent magnet. The ratio of the magnet inner width to the radius of the circular arc is between 0.3 and 0.5, and the ratio of the magnet height to the magnet inner width is between 0.3 and 0.6.

In another exemplary embodiment, a magnetic filter assembly comprises a structural frame having a mounting cavity, a flux return plate disposed within the mounting cavity, and a plurality of permanent magnets mounted against the flux return plate within the mounting cavity and forming the shape of a partial cylinder. The plurality of permanent magnets are oriented such that a magnetic axis of each permanent magnet is perpendicular to the flux return plate. The plurality of permanent magnets includes a first set of permanent magnets arranged along a first spiral path that begins proximate a first end of magnetic filter assembly, extends at least partially around the magnetic filter assembly in an azimuthal direction of the partial cylinder, and terminates proximate a second end of the magnetic filter assembly.

In another exemplary embodiment, a magnetic filter system comprises a first magnetic array comprising a series of interleaved magnets of opposite polarity, and a second magnetic array comprising a series of interleaved magnets of opposite polarity. The first magnetic array and the second magnetic array are configured to couple to an oil filter to achieve a magnetic filtered fluid flow ratio of 100% in the oil filter.

The contents of this summary section are provided only as a simplified introduction to the disclosure, and are not intended to be used to limit the scope of the appended claims.

BRIEF DESCRIPTION OF THE DRAWINGS

With reference to the following description, appended claims, and accompanying drawings:

FIG. 13 shows the data of FIG. 12 in tabular form.

DETAILED DESCRIPTION

Figure 1A:
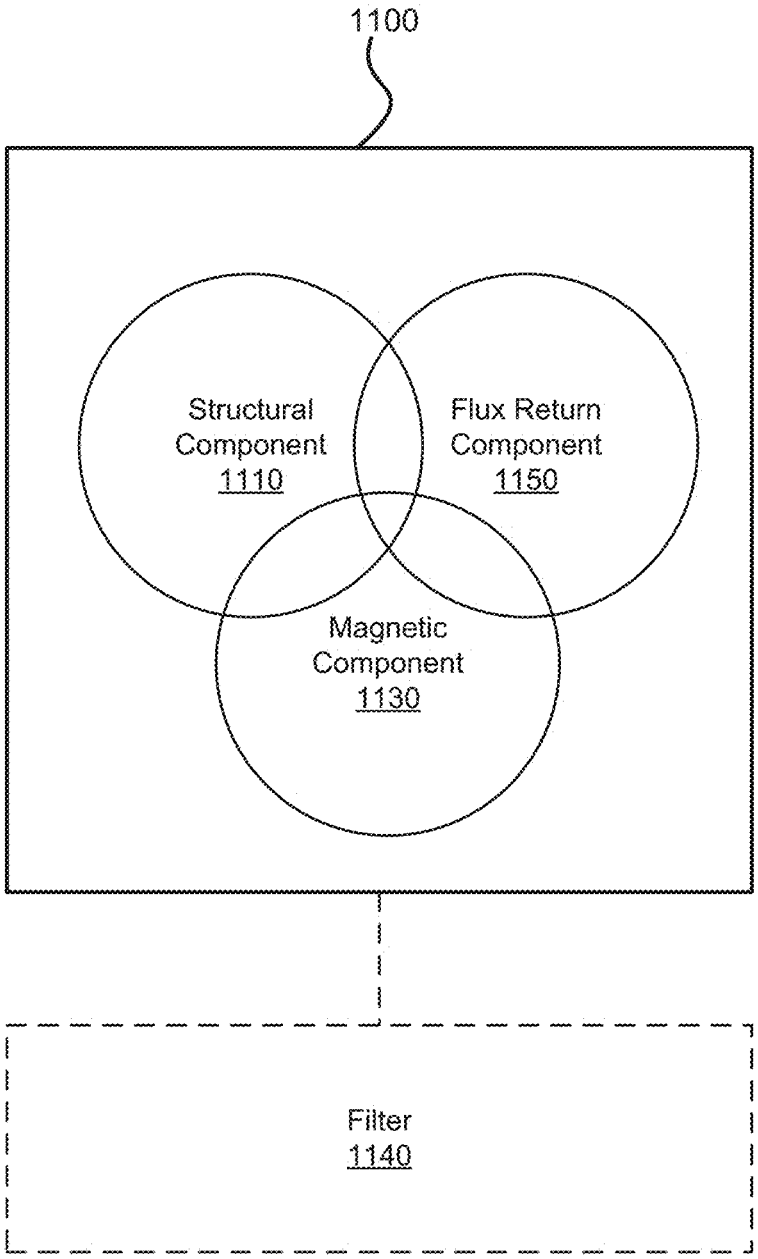
FIG. 1A illustrates a block diagram of an exemplary magnetic filter system in accordance with an exemplary embodiment.

The following description is of various exemplary embodiments only, and is not intended to limit the scope, applicability or configuration of the present disclosure in any way. Rather, the following description is intended to provide a convenient illustration for implementing various embodiments including the best mode. As will become apparent, various changes may be made in the function and arrangement of the elements described in these embodiments without departing from the scope of the appended claims.

For the sake of brevity, conventional techniques for magnetic flux utilization, concentration, direction, configuration, control, and/or management, may not be described in detail herein. Furthermore, the connecting lines shown in various figures contained herein are intended to represent exemplary functional relationships and/or physical couplings between various elements. It should be noted that many alternative or additional functional relationships or physical connections may be present in a practical magnetic system, for example a magnetic filter system.

Various shortcomings of prior filters, including magnetic filters, can be addressed by utilizing magnetic filter systems configured in accordance with principles of the present disclosure. As used herein, a "magnetic filter system" may be any system whereby magnetic force is utilized to capture particulate matter and remove it from a carrier fluid. A magnetic filter system may have integrated magnetic components. Alternatively, a magnetic filter system may comprise magnetic components and be configured to add-on and/or couple to a conventional filter system, for example an engine oil filter, fuel filter, hydraulic fluid filter, turbine oil filter, drilling mud filter, gearbox lube filter, and/or the like. Additionally, a magnetic filter system may be utilized in place of a membrane filter, for example while attached to a pipe or wide section of tubing (either pre-existing, or added for filtering or decreasing flow velocity to improve filtering). It will be appreciated that principles of the present disclosure are applicable to a wide variety of fluid handling and/or delivery systems, for example foodstuff fluid handling systems, industrial chemical processing systems, resin processing systems, water treatment systems, lubrication systems, machine tool coolant systems, and/or the like. Additionally, magnetic filter systems configured in accordance with principles of the present disclosure may be suitable to retrofit and/or supplement existing filtration approaches, improving overall filtration effectiveness and/or reducing wear.

Ferromagnetic particles are attracted by a vector product of magnetic field and magnetic gradient multiplied by a term that varies with the volume of a particle along with appropriate constants. Therefore, larger particles are greatly more probable to be magnetically removed from a fluid flow than smaller particles. Exemplary magnetic filter systems configured in accordance with principles of the present disclosure employ techniques to enable removal of many particles smaller than those usually passed by conventional membrane filtration. Exemplary magnetic filter systems also capture more particles than present magnetic filter designs while being more efficient with magnetic material.

Additionally, in accordance with principles of the present disclosure, a magnetic filter system may be configured to achieve an improved filtered fluid flow ratio. Most filter operations are "full flow" in that the total flow, for example of the lubrication or hydraulic system, passes through a common filter. This filter is in place to (i) remove particles from the fluid, and (ii) protect the equipment from catastrophic wear failure in that it provides time for shut down without complete destruction of the bearing surfaces.

Typical filters usually pass particles up to about 20-30 microns in diameter. A finer filter would require significant increases in pumping power, resulting in increased heat, fluid charging and system inefficiency.

As used herein, a "magnetic filtered fluid flow ratio" represents the portion of full fluid flow in a filter (for example, between a filter outer wall and filter media in an oil filter) wherein ferromagnetic particulates are subjected to a magnetic energy product sufficient to attract the size and type of ferromagnetic particles expected to be present in the fluid. Once at the filter wall, the particles are held in place until disposed of with the filter or cleaned from the inner wall of a cartridge filter. Particles attracted to the filtration can wall become arranged in a close packed geometry to minimize packing energy. This packed geometry becomes fixed in place by weakly magnetizing the particles and can also become further fixed in place over time by cementing the particles with high molecular weight components from the fluid, for example oil. In this manner, the number of particulates in a fluid stream may be reduced, reducing device wear and improving fluid quality.

Yet further, in accordance with principles of the present disclosure, a magnetic filter system may be configured to achieve magnetic energy penetration, for example a magnetic field penetration of sufficient magnitude to capture particles and move them to the can wall over the radial distance range between the outer wall and the outer beginning of the filter media. Principles of the present disclosure contemplate using one or more parameters such as flow rate, can length, can wall material, can wall thickness, operating temperature range, particle size, particle material, flow injection geometry, filter media geometry, fluid viscosity, and fluid additive parameters in order to configure an exemplary magnetic filter system.

In accordance with an exemplary embodiment, and with reference now to FIG. 1A, a magnetic filter system, for example magnetic filter system 1100, generally comprises a structural component 1110, a magnetic component 1130, and a flux return component 1150. Structural component 1110 provides support and/or shaping of magnetic filter system

1100. Magnetic component 1130 is coupled to and/or supported by structural component 1110. Magnetic component 1130 is configured to generate a magnetic field extending therefrom, for example into the interior of a fluid filter to which magnetic filter system 1100 is coupled. Flux return component 1150 is coupled to and/or supported by structural component 1110. Flux return component 1150 is configured to reduce flux leakage from magnetic filter system 1100 and/or to increase the size and/or strength of a magnetic field generated by magnetic component 1130, for example, in a direction facing generally into a fluid filter. Moreover, magnetic filter system 1100 may comprise any suitable components configured to result in a magnetic field in a filter 1140, for example an oil filter or fuel filter, and/or facilitate physical and/or magnetic coupling and/or decoupling between magnetic filter system 1100 and a filter 1140. FIG. 1A utilizes intersecting circles to indicate the foregoing elements of an exemplary magnetic filter system 1100, as these parts may intersect in function and/or material. For example, flux return component(s) 1150 may provide some or the entire structural component 1110, magnetic component 1130 may supply a flux return function, and so forth. In various exemplary embodiments, magnetic filter system 1100 and/or components thereof (for example, magnetic component 1130) is configured in the shape of a partial cylinder so as to be suitable for removably coupling to a cylindrical filter 1140, for example an oil filter or fluid filter.

As used herein, a "partial cylinder" may be considered to be the shape formed by extending a circular arc along a line segment containing the center point of the circular arc. The line segment lies along the longitudinal axis of the partial cylinder, and the distance between the line segment and the circular arc is the radius of the circular arc (and thus, the radius of the corresponding partial cylinder). With respect to a partial cylinder, a distance along (or parallel to) the longitudinal axis may be referred to herein as a distance in the "longitudinal direction"; a distance along a line extending radially outward from the longitudinal axis and intersecting the partial cylinder at a perpendicular angle may be referred to herein as a distance in the "radial direction"; and a distance along the circular arc may be referred to herein as a distance in the "azimuthal direction."

Figure 1B:
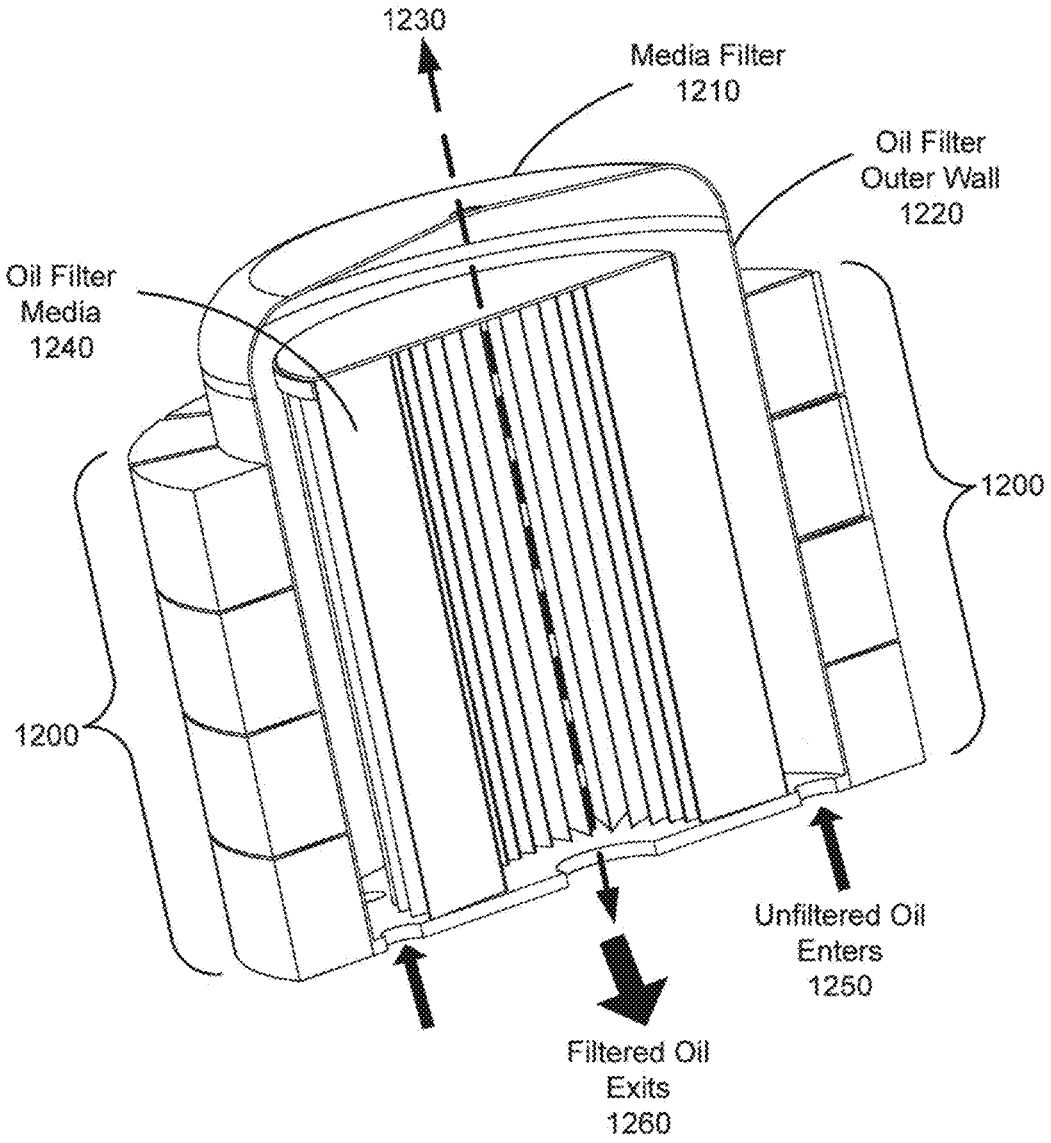
FIG. 1B illustrates a cut-away view of an exemplary magnetic filter system coupled to a conventional oil filter in accordance with an exemplary embodiment.

Turning now to FIG. 1B, operation of an exemplary magnetic filter system 1200 is illustrated. Magnetic filter system 1200 is attachable to a media filter 1210, for example an oil filter or fuel filter. A typical fluid filter, for example an oil filter, comprises a cylindrical outer wall or "can" 1220 having a central axis 1230, an inner filter media 1240, one or more fluid inlets 1250, and a fluid outlet 1260. The fluid inlets 1250 are typically arranged around the outer edges of the paper, cloth, membrane or fabric filter media 1240. Fluid enters the filter through the inlets 1250, travels at least a portion of the axial length of the filter, passes through the inner filter media 1240, and leaves the filter through the fluid outlet 1260. Magnetic filter system 1200 is configured to be disposed along and/or couple to a portion of the filter wall or can 1220. Certain exemplary magnetic filter systems are configured for use with what is commonly called a "cartridge" system. A cartridge system is one where the filter media assembly is removed from a can and only the filter media is disposed.

In an exemplary embodiment, magnetic filter system 1200 results in a magnetic field gradient and a magnetic field existing in at least a portion of the region between a filter outer wall and the outer part of the inner filter media. Principles of the present disclosure conclude that it is desirable to achieve a high magnetic field*magnetic gradient vector product. In response to the magnetic field gradient and magnetic field vector product, ferromagnetic particulates suspended in the fluid are attracted to the filter can wall and are bound thereto by the magnetic field. In this manner, ferromagnetic particulates, and specifically ferromagnetic particulates that may be too small to be captured by the filter media, may be effectively removed from the fluid stream. Moreover, multiple magnetic components 1200 may be employed to increase the radial and/or axial surface area of a filter to attempt to expose the total flow to an effective force field whose intensity is proportional to the magnetic field*magnetic gradient vector product.

Figure 2A:
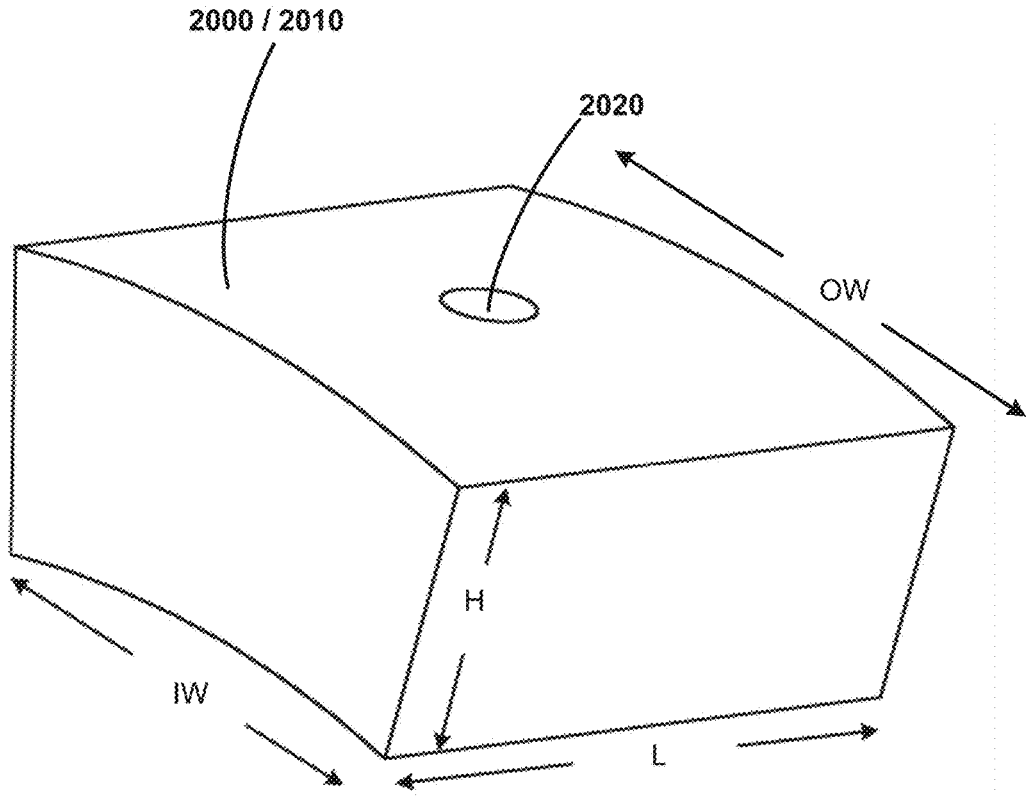
FIG. 2A illustrates a single magnetic element of a magnetic array in accordance with an exemplary embodiment.

With reference now to FIG. 2A, in various exemplary embodiments, magnets 2000/2010 may be configured to increase and/or maximize magnetic field penetration and/or magnetic field gradient in a fluid volume between a filter media and a filter outer wall. In certain exemplary embodiments, magnets 2000/2010 are configured with a height H of about ½ an inner width IW. In various exemplary embodiments, magnets 2000/2010 are configured with a height H of between about 40% IW and about 60% IW. Moreover, magnets 2000/2010 may be configured with a height H of greater than 600% IW, for example to account for magnetic decay over time, to compensate for a thick or high saturation can wall, to compensate for operation at extended high temperature, and/or the like. It will be appreciated that the foregoing ratios are optimized for N42SH magnetic material and may be scaled to other magnetic material in an approximately linear relationship, with weaker magnetic material requiring thicker magnets 2000/2010.

Additionally, in various exemplary embodiments, magnets 2000/2010 are configured with an inner width IW of between about 20% of the diameter of a filter and about 70% of the diameter of a filter. In certain exemplary embodiments, magnets 2000/2010 are configured with an inner width IW of between about 40% of the diameter of a filter and about 50% of the diameter of a filter. It will be appreciated that wider magnetic structures extend significant magnetic field gradient product deeper into the interior of a filter. Moreover, magnets in various exemplary magnetic filter systems disclosed herein may be configured with inner widths having a defined relationship to the diameter of a corresponding filter and/or pipe.

In an exemplary embodiment, magnets 2000/2010 are configured with an inner width IW of about 22 mm and a height H of about 11 mm. This geometry is approximately optimum for a can inner wall to outer extent of the filter media spacing of between about 6 mm and about 7 mm and a medium steel can wall of between about 0.5 mm and about 0.75 mm thickness. It will be appreciated that exemplary magnetic filter systems configured for use with other filter designs will utilize differing magnetic package parameters. For example, a magnetic filter system configured for use in connection with a large filter or pipe (i.e., structures having a comparatively thick wall of about 6.3 mm and/or having no filter material in the interior thereof) may be configured with magnets 2000/2010 having a height H of between about 25 mm and about 45 mm and an inner width IW of between about 45 mm and about 75 mm depending on can/tube diameter. In this manner, magnets 2000/2010 may adequately saturate the thick wall and/or project a suitable magnetic field*gradient product into the middle of the filter or pipe. In various exemplary embodiments, magnets 2000/2010 are configured with an inner width IW of between about 15 mm and about 50 mm. In various exemplary embodiments, magnets 2000/2010 are configured with a height H of between about 8 mm and about 25 mm.

Moreover, magnets 2000/2010 may be sized in any suitable manner to achieve a desired magnetic field penetration and/or magnetic field strength in a fluid volume between a filter media and a filter outer wall.

It will be appreciated that magnets 2000/2010 may be configured with an inner width IW smaller than an outer width OW, for example to facilitate disposition of magnets 2000/2010 about a curved surface such as a filter outer wall. Moreover, magnets 2000/2010 may be tapered, angled, and/or otherwise configured to couple to one another and/or to a structural component/flux return path. In certain exemplary embodiments, magnets 2000/2010 are configured to be curved and/or angled in order to closely align with and/or couple to a filter outer wall, in these exemplary embodiments, the curvature of the inner side of magnets 2000/2010 corresponds closely to the curvature of a filter outer wall. Additionally, magnets 2000/2010 may be configured with edge magnet features which reduce flux loss to adjacent magnets. Moreover, the edge features may provide interlocking of magnets 2000/2010 in a flexible manner, improving the fit between the face of magnets 2000/2010 and the filter can wall. The edge features can also enable radial and/or axial linking of sections of magnets 2000/2010.

In various exemplary embodiments, individual magnets 2000 and 2010 are configured with 2000 having north field on the outer surface (i.e., the larger curved surface) and 2010 having south field on the outer surface. Magnetic arrays may be comprised of the magnet 2000/2010 building blocks.

In various exemplary embodiments, magnets 2000/2010 have a hole 2020, for example in the middle, for use in attachment to a support/return flux assembly and/or for handling.

Continuing to reference FIG. 2A, in accordance with various exemplary embodiments, in an exemplary magnetic filter system a magnetic component comprises one or more permanent magnets. Magnets 2000/2010 may comprise any suitable magnetic material. In an exemplary embodiment, magnet 2000 has the north pole on the larger diameter face, while magnet 2010 has the south pole on the larger diameter face. In various exemplary embodiments, magnets 2000/2010 comprise neodymium alloy N42SH or similar. Additionally, magnets 2000/2010 may be configured to operate reliably in harsh automotive and/or industrial conditions, for example temperatures up to about 300 degrees Fahrenheit.

Figure 2B:
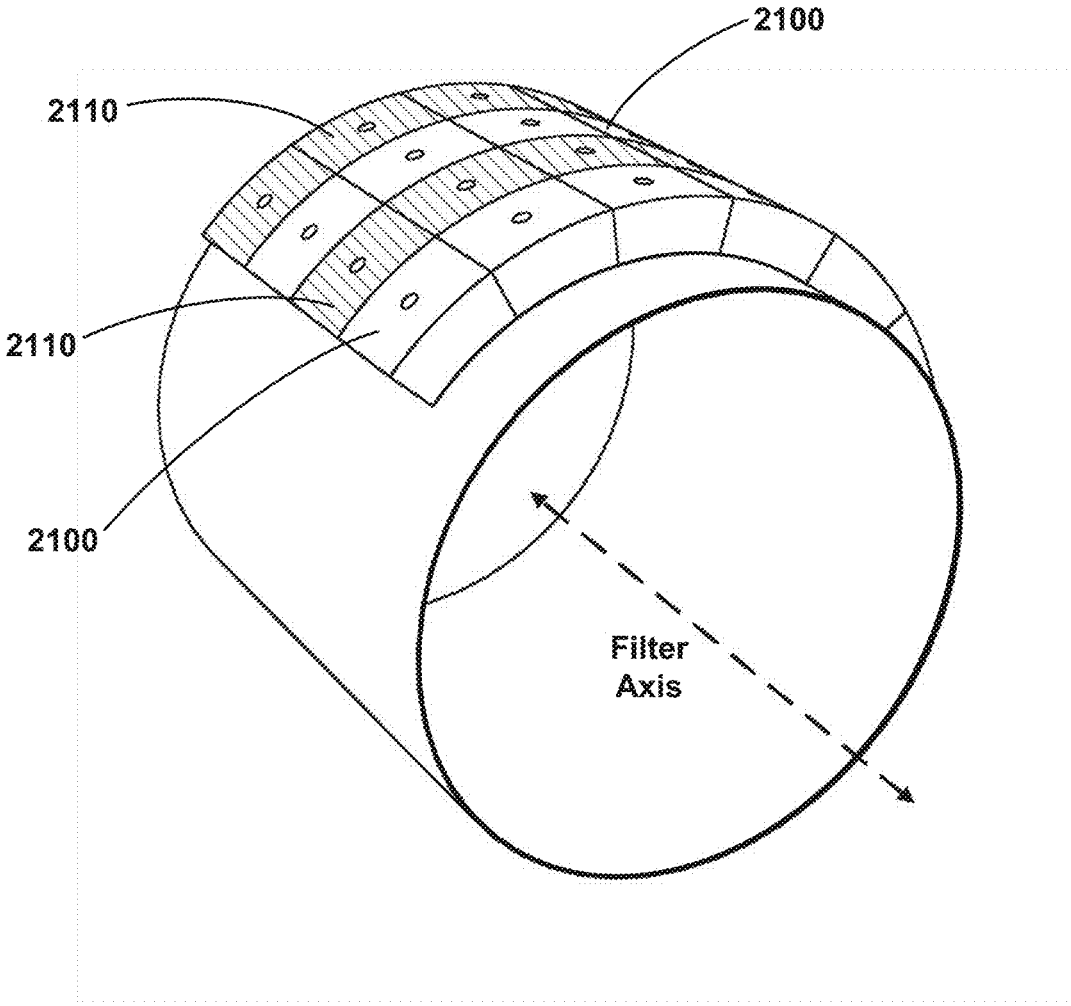
FIGS. 2B and 2C illustrate exemplary magnetic components of an exemplary magnetic filter system, configured in a "ring"-like arrangement in accordance with an exemplary embodiment.

Turning now to FIG. 2B, in various exemplary embodiments a magnetic filter system 1100 comprises a magnetic array. Magnet 2100 is configured with the north pole away from the filter axis, and magnet 2110 is configured with the north pole toward the filter axis. The general pattern is of rings of common poled magnets, with each ring in the axial direction alternate in pole direction.

In various exemplary embodiments, the boundary between magnets of opposite polarity, for example the boundary between axial rings illustrated in FIG. 2B, gives rise to magnetic "borders" with every ring. As used herein, a "magnetic border" may be considered to be a region wherein a magnet, for example magnet 2100, of a first polarity abuts, or shares an edge with, or closely approaches a magnet, for example magnet 2110, of a second polarity. Moreover, a "magnetic border" may be considered to be a line passing through the points in a magnetic field, as measured on the interior face of the filter can, where polarity in the radial direction reverses. Yet further, a "magnetic border" may be considered to be a region closest to a filter can wall where the magnetic force on the particle is maximum, for example as experimentally confirmed in a deposition pattern of particles seen on the interior of a filter can after use of an exemplary magnetic filter system 1100.

In various exemplary embodiments, magnetic filter system configurations with more magnetic border length have a higher filter particulate storage capacity, which is to say a magnetic filter system with larger magnetic border length will store more ferrous material on the filter walls before the hold on that material becomes tenuous and further particles are swept away in the flow stream. Moreover, in various exemplary embodiments magnetic arrays are designed to increase and/or maximize (i) the number of magnetic borders traversed by a particulate moving through the fluid volume in a filter, (ii) the distance a particulate moves laterally along a magnetic border while moving through the fluid volume in a filter, and/or both (i) and (ii). As used herein, to "traverse" a magnetic border means to pass through a region wherein the magnetic field, as measured at the interior filter can wall, has a first polarity into a region where the magnetic field has a second, opposite polarity.

Figure 2C:
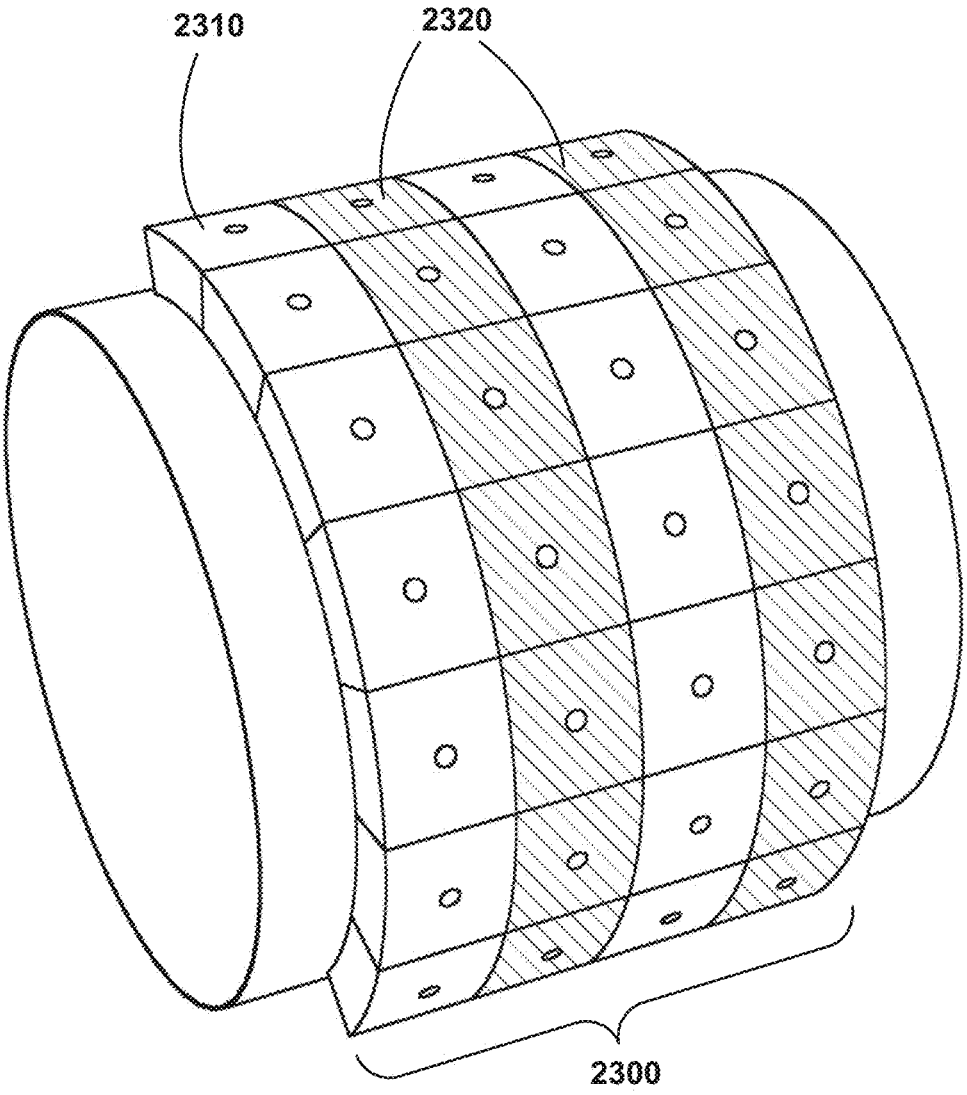

With reference now to FIG. 2C, a different viewing angle of FIG. 2B, an exemplary magnetic filter system may comprise a series of full or partial "ring"-like structures. The array 2300 comprises a series of alternating polarity "rings" along the direction of a filter axis, for example a ring of magnets 2310, then a ring of magnets 2320, then a ring of magnets 2310, and so forth. As illustrated in FIG. 2C, exemplary magnetic array 2300 comprises four rings. Moreover, any suitable number of rings may be utilized, for example depending on the dimensions of magnets 2310 and/or 2320, an axial length of a filter, space available in a filter enclosure, and/or the like. It will be appreciated that as the number of rings increases, the number of magnetic borders a particulate may potentially traverse as it moves through the fluid volume in a filter is also increased. Additionally, magnetic border length is also increased, increasing the holding capacity of the exemplary magnetic filter system.

In various exemplary embodiments, ring structures in magnetic array 2300 may extend any suitable distance around a filter, for example 30 degrees, 60 degrees, 90 degrees, 120 degrees, 180 degrees, and/or 360 degrees. In some exemplary embodiments, magnet array 2300 covers up to 100% of the radial surface area of a filter outer wall. Moreover, multiple magnetic arrays 2300 may be utilized with a single conventional filter. For example, two exemplary magnetic filter systems, each extending approximately 180 degrees around a conventional filter, may be utilized to achieve nearly 360 degree coverage of the conventional filter. It will be appreciated that the number of rings is a degree of freedom for the designer, for example to adjust the force of an individual sub assembly of the magnetic array to ease attachment and removal, miss areas of close tolerance in the region/vicinity of the filter mounting, allow areas for finger holds to ease mounting and removal, and the like. Additionally, it will be appreciated that each magnetic array 2300 may be sized and/or configured to be removable by a user, for example via snapping on and sliding off an oil filter.

Figure 3:
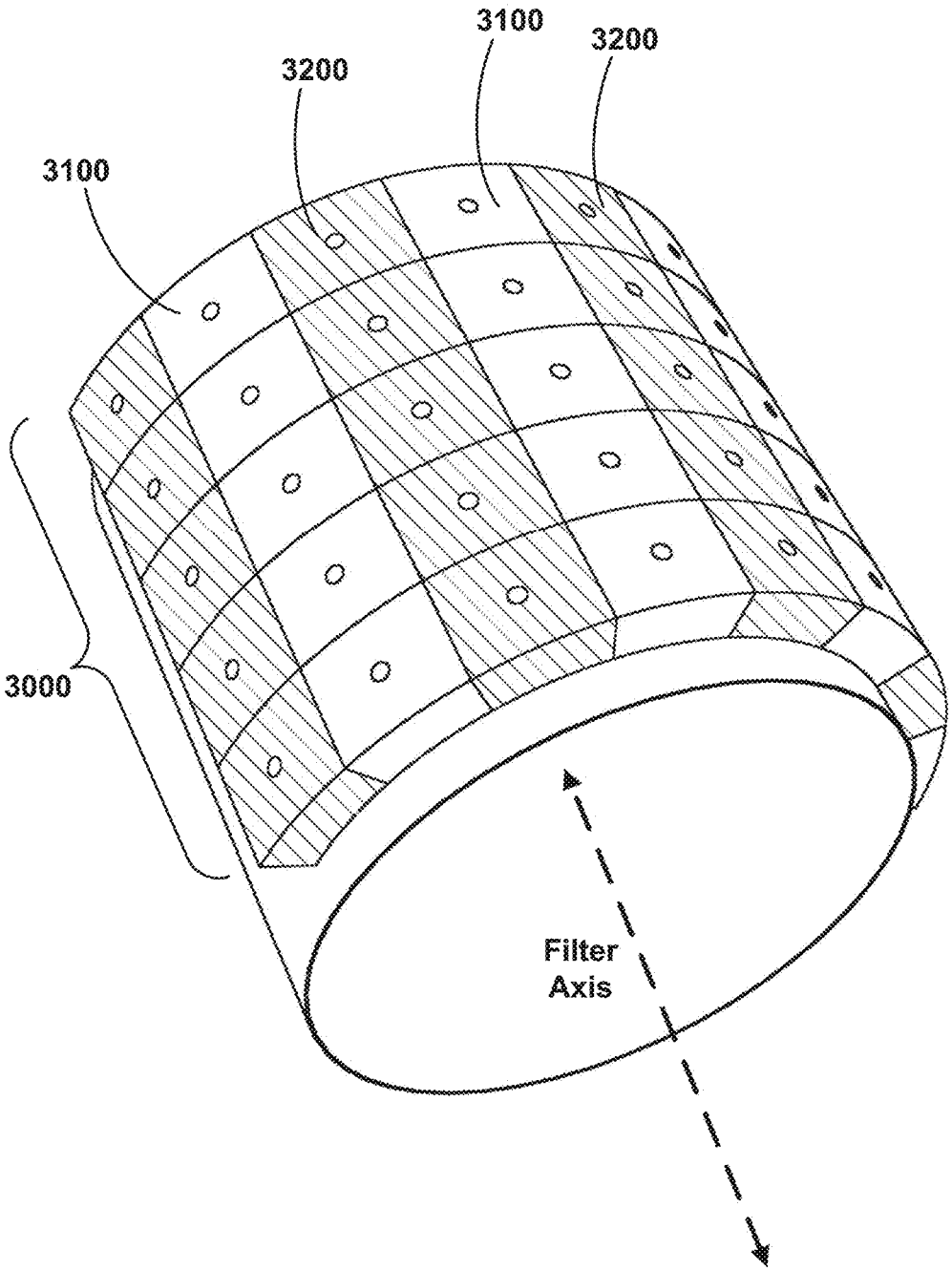
FIG. 3 illustrates exemplary magnetic components of an exemplary magnetic filter system, configured in a "long linear" arrangement in accordance with an exemplary embodiment.

With reference now to FIG. 3, in certain exemplary embodiments magnetic array 3000 comprises a series of linear structures of alternating polarity. In these exemplary embodiments, magnets 3100, 3200 (or groups thereof) may extend along a line parallel to a filter axis. Magnetic array 3000 may comprise a series of alternating lines, for example a line of magnets 3100 with north pole out, then a line of magnets 3200 with south pole out, then a line of magnets 3100 again with north pole out, and so forth. In an exemplary embodiment, magnetic array 3000 comprises four lines. Magnetic array 3000 can be comprised of as few as 2 lines, or as many as is possible to be placed on the filter can wall diameter (which could be many feet in diameter). Additionally, the line length can extend along the line parallel to the filter axis as long as necessary to cover the fluid flow (which may be many feet in length).

Any suitable number of lines may be utilized, for example depending on the dimensions of magnets 3100/3200, the radius of a filter, space available in a filter enclosure, and/or the like. It will be appreciated that as the number of lines increases in a linear magnetic array 3000, (i) the distance a particulate in a filter may potentially travel along a magnetic border or borders is also increased, and (ii) the total magnetic border length is increased, increasing holding capacity. In accordance with principles of the present disclosure, the longer the path, the smaller a particle trapped, and the more efficiency the exemplary magnetic filter system achieves.

Figure 4:
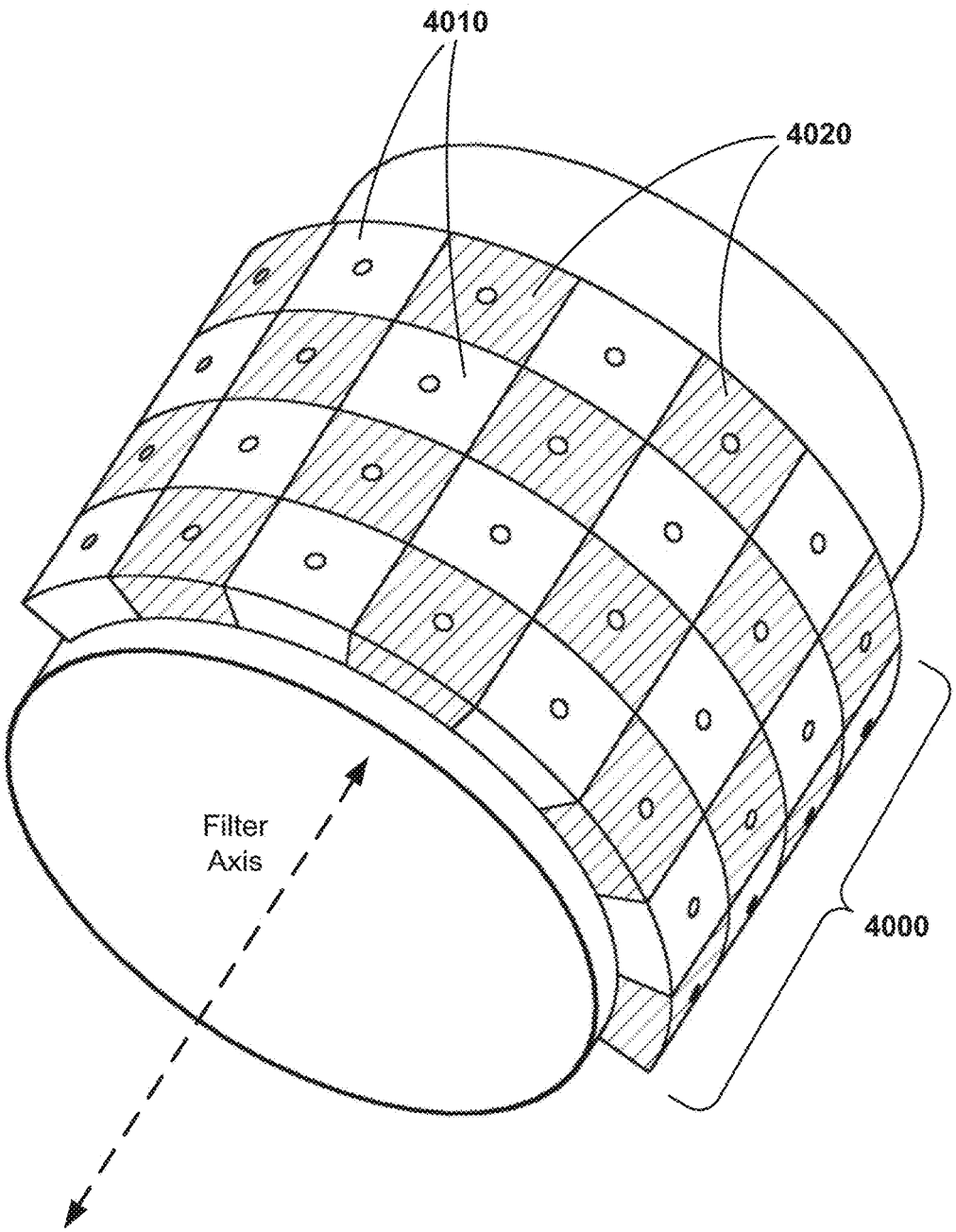
FIG. 4 illustrates exemplary magnetic components of an exemplary magnetic filter system, configured in a "checkerboard" arrangement in accordance with an exemplary embodiment.

With reference now to FIG. 4, in certain exemplary embodiments magnetic array 4000 comprises an interleaved and/or "checkerboard" pattern. Multiple magnets 4010, 4020 where 4010 has opposite poling as 4020, are interleaved in a checkerboard pattern of alternating polarities. In these embodiments, opposite poled magnets 4010 and 4020 may have generally equal lengths L and outer widths OW; alternatively, magnets 4010, 4020 may have outer widths OW greater than lengths L (leading to a "ring-like" rectangular checkerboard pattern where the longer magnetic borders run circumferentially along the filter outer wall) or outer widths OW less than lengths L (leading to a "line-like" rectangular checkerboard pattern where the longer magnetic borders run parallel to the filter axis). In an exemplary embodiment, magnetic array 4000 comprises 4 columns of interleaved magnets 4010, 4020. In other exemplary embodiments, magnetic array 4000 comprises as few as 2 columns or as many as several hundred columns of interleaved magnets 4010, 4020. Any suitable number of columns may be utilized, for example depending on the dimensions of magnets 4010 and/or 4020, a radius of a filter, pipe or tank, space available in a filter enclosure, and/or the like. Moreover, multiple checkerboard patterns may be utilized in a magnetic array 4000, for example a first pattern in a first portion of magnetic array 4000, and a second pattern in a second portion of magnetic array 4000. It will be appreciated that as the number of columns increases and/or as the axial length of a column increases, (i) the distance a particulate in a filter may potentially travel along a magnetic border or borders is also increased, and/or (ii) the number of magnetic borders a particulate may potentially cross as it moves through the fluid volume in a filter is also increased.

Figure 5A:
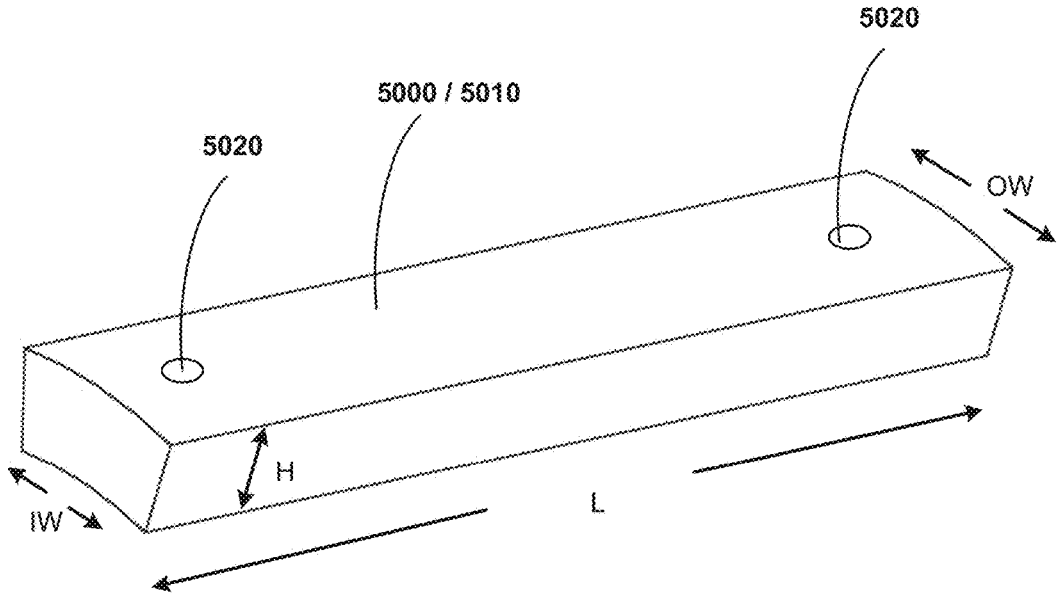
FIG. 5A illustrates a long bar magnetic component configured to simplify a long linear magnetic filter system in accordance with an exemplary embodiment.
Figure 5B:
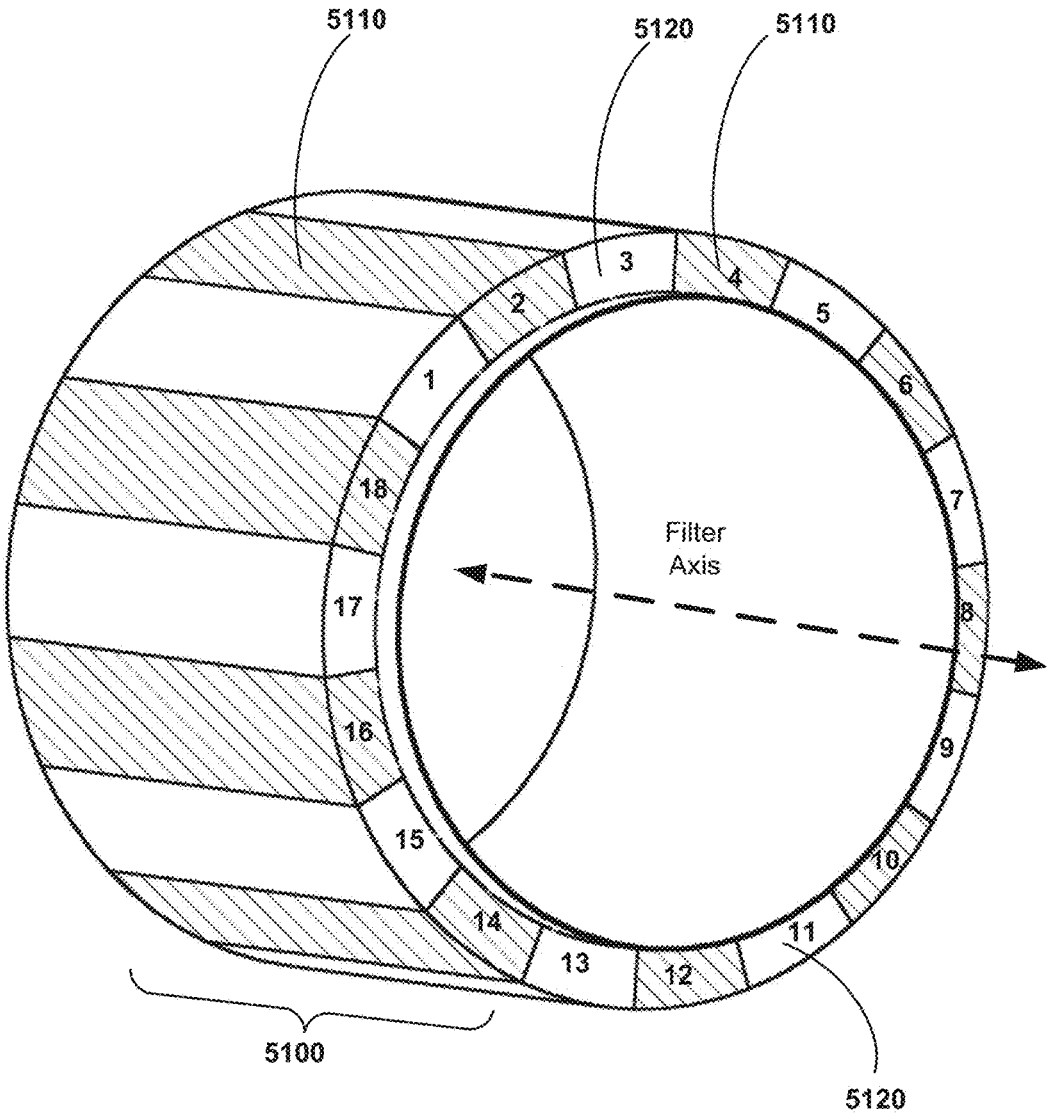
FIG. 5B illustrates a linear magnet array in an magnetic filter system configured to extend all the way around the circumference of an oil filter in accordance with an exemplary embodiment.
Figure 6:
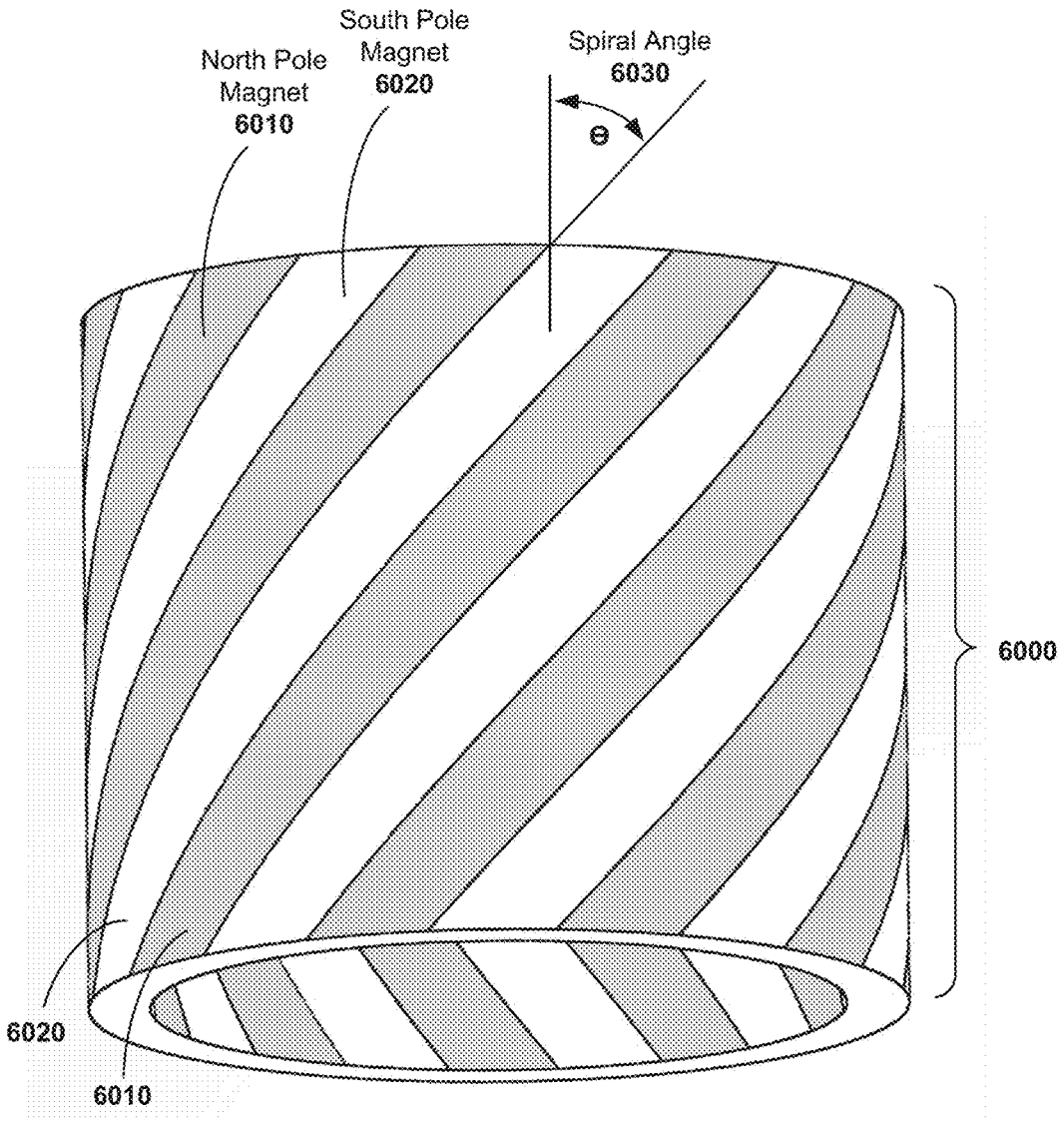
FIG. 6 illustrates magnetic components configured with a constant spiral path in accordance with an exemplary embodiment.

Turning now to FIGS. 5A, 5B, and 6, in various exemplary embodiments a magnetic component is configured to partially and/or completely encircle a filter in a circumferential direction. In certain of these exemplary embodiments, magnets 5110, 5120 may extend substantially the axial length of a filter and be interleaved all the way around the filter, as illustrated in FIG. 5B. In other exemplary embodiments, various groups of magnets 5110, 5120 may be employed in a suitable pattern to extend substantially the axial length of a filter and be interleaved all the way around the filter. In various exemplary embodiments, a magnetic component extends all the way around the filter and covers as much of the axial length of the filter as is suitable to achieve a desired filter performance at a selected particle size. In an exemplary embodiment, a magnetic component extends all the way around the filter and covers at least 50% of the axial length of the filter. In another exemplary embodiment, a magnetic component extends all the way around the filter and covers at least 75% of the axial length of the filter. In another exemplary embodiment, a magnetic component extends all the way around the filter and covers 100% of the axial length of the filter. In various exemplary embodiments, a magnetic component extends all the way around the filter and covers at least as much of the axial length of the filter as is consistent with attracting sufficient particles and/or the cost of the magnets.

Turning again to FIG. 5A, in various exemplary embodiments, magnet 5000/5010 may be configured to increase and/or maximize magnetic field penetration and/or magnetic field gradient in a fluid volume between a filter media and a filter outer wall. In certain exemplary embodiments, magnets 5000/5010 are configured with a height H of about ½ an inner width IW. The length of the magnet 5000/5010 may be the length of the array segment. This design is useful in linear array configurations as it reduces parts count and increases the simplicity of manufacturing. In various exemplary embodiments, magnets 5000/5010 are configured with a height H of between about 40% IW and about 60% IW. Moreover, magnets 5000/5010 may be configured with a height H of greater than 60% IW, for example to account for magnetic decay over time, to compensate for a thick or high saturation can wall, or to compensate for operation at extended high temperature.

In an exemplary embodiment, magnets 5000/5010 are configured with an inner width IW of about 22 mm and a height H of about 11 mm. This geometry is approximately optimum for a can inner wall to outer extent of the filter media spacing of between about 6 mm and about 7 mm and a medium steel can wall of between about 0.5 mm and about 0.75 mm thickness. Other filter designs may utilize changes to the magnetic package parameters. In various exemplary embodiments, magnets 5000/5010 are configured with an inner width IW of about between about 15 mm and about 50 mm. In various exemplary embodiments, magnets 5000/5010 are configured with a height H of about between about 6 mm and about 30 mm. Moreover, magnets 5000/5010 may be sized in any suitable manner to achieve a desired magnetic field gradient*magnetic field strength product in the fluid volume between a filter media and a filter outer wall.

It will be appreciated that magnets 5000/5010 may be configured with an inner width IW smaller than an outer width OW, for example to facilitate disposition of magnets 5000/5010 about a curved surface such as a filter outer wall. Moreover, magnets 5000/5010 may be tapered, angled, and/or otherwise configured to couple to one another and/or to a structural component and/or flux return path component. In certain exemplary embodiments, magnets 5000/5010 are configured to be curved and/or angled in order to closely align with and/or couple a filter outer wall; in these exemplary embodiments, the curvature of the inner side of magnets 5000/5010 corresponds closely to the curvature of a filter outer wall.

In various exemplary embodiments, individual magnets 5000 and 5010 are configured with 5000 having north pole on the larger curved wall and 5010 poled so that the south field is on the larger curved surface. Magnetic arrays are comprised of the magnet 5000/5010 building blocks.

With reference now to FIG. 5B, in certain exemplary embodiments, magnetic array 5100 comprises a "linear" pattern. Multiple magnets 5110, 5120 (where 5110 has opposite poling as 5120) are interleaved in a linear pattern in the axial direction of alternating polarities. In these exemplary embodiments, opposite poled magnets 5110 and 5120 may have generally equal lengths L and outer widths OW; alternatively, magnets 5110, 5120 may have outer widths OW less than lengths L (i.e., a linear pattern where the longer magnetic borders run in the axial direction along the filter outer wall). In an exemplary embodiment, magnetic array 5100 comprises 18 circumferential interleaved magnets 5110, 5120. In other exemplary embodiments, magnetic array 5100 comprises as few as 2 columns or as many as several hundred columns of interleaved magnets 5110, 5120. Any suitable number of columns may be utilized, for example depending on the dimensions of magnets 5110 and/or 5120, a radius of a filter, pipe or tank, space available in a filter enclosure, and/or the like. It will be appreciated that as the number of columns increases, the axial length of the application area increases and the distance a particulate in a filter may potentially travel along a magnetic border or borders is also increased. Additionally, the total magnetic border length in the exemplary magnetic filter system is also increased, increasing holding capacity.

With reference now to FIG. 6, in various exemplary embodiments, in magnetic array 6000, magnets 6010, 6020 may be arranged in various patterns, for example a spiral/helical pattern, a stretcher bond pattern, a raking stretcher bond pattern, a monk bond pattern, and/or the like. Moreover, magnetic array 6000 may employ multiple patterns. For example, magnetic array 6000 may be configured with a first pattern in an area intended to be placed close to an oil inlet in a filter, a second pattern in an area intended to be placed approximately midway between the ends of a filter, and a third pattern in an area intended to be placed roughly adjacent the filter sidewalls furthest from the oil inlet, and so forth. The pattern can be designed to vary as the flow velocity varies in the annular area between the outer extent of the filter element and the inner wall of the filter can. For example, the pattern can vary such that, as the flow velocity decreases, the angle of the magnetic border with respect to a linear flow direction down the wall of the can is increased. In an exemplary embodiment, magnetic filter system 6000 is configured with at least two patterns, each having a particulate capture characteristic different from the other. It will be appreciated that selection of a pattern or patterns may be based at least in part on particulate size, oil velocity, oil filter volume, oil filter outer wall thickness, oil filter outer wall material, magnet material, and/or the like.

In some exemplary embodiments, magnetic component 6000 is configured with magnets 6010, 6020 in a constant spiral pattern. The spiral pattern may be configured with any suitable pitch, illustrated as angle 6030 in FIG. 6. In one exemplary embodiment, magnetic array 6000 is configured with magnets 6010, 6020 in a spiral pattern traversing about 90 degrees in pitch along the axial length of the filter. In another exemplary embodiment, magnetic array 6000 is configured with magnets 6010, 6020 in a spiral pattern traversing about 360 degrees in pitch (i.e., one complete turn) along the axial length of the filter. In yet another exemplary embodiment, magnetic array 6000 is configured with magnets 6010, 6020 in a spiral pattern traversing about 3600 degrees in pitch (i.e., ten complete turns) along the axial length of the filter. In yet another exemplary embodiment, magnetic array 6000 is configured with magnets 6010, 6020 in a spiral pattern traversing about 36000 degrees in pitch (i.e., one hundred complete turns) along the axial length of the filter. It will be appreciated that the number of turns of the spiral pattern may vary with the axial length of the filter or pipe. In these exemplary embodiments, particulates can at least partially follow the spiral pattern as they move through the filter, thus experiencing a longer path under the influence of a magnetic border generated by magnets 6010, 6020 than would be possible in a straight line along the axis of the filter, thus increasing particulate capture effectiveness.

Figure 7:
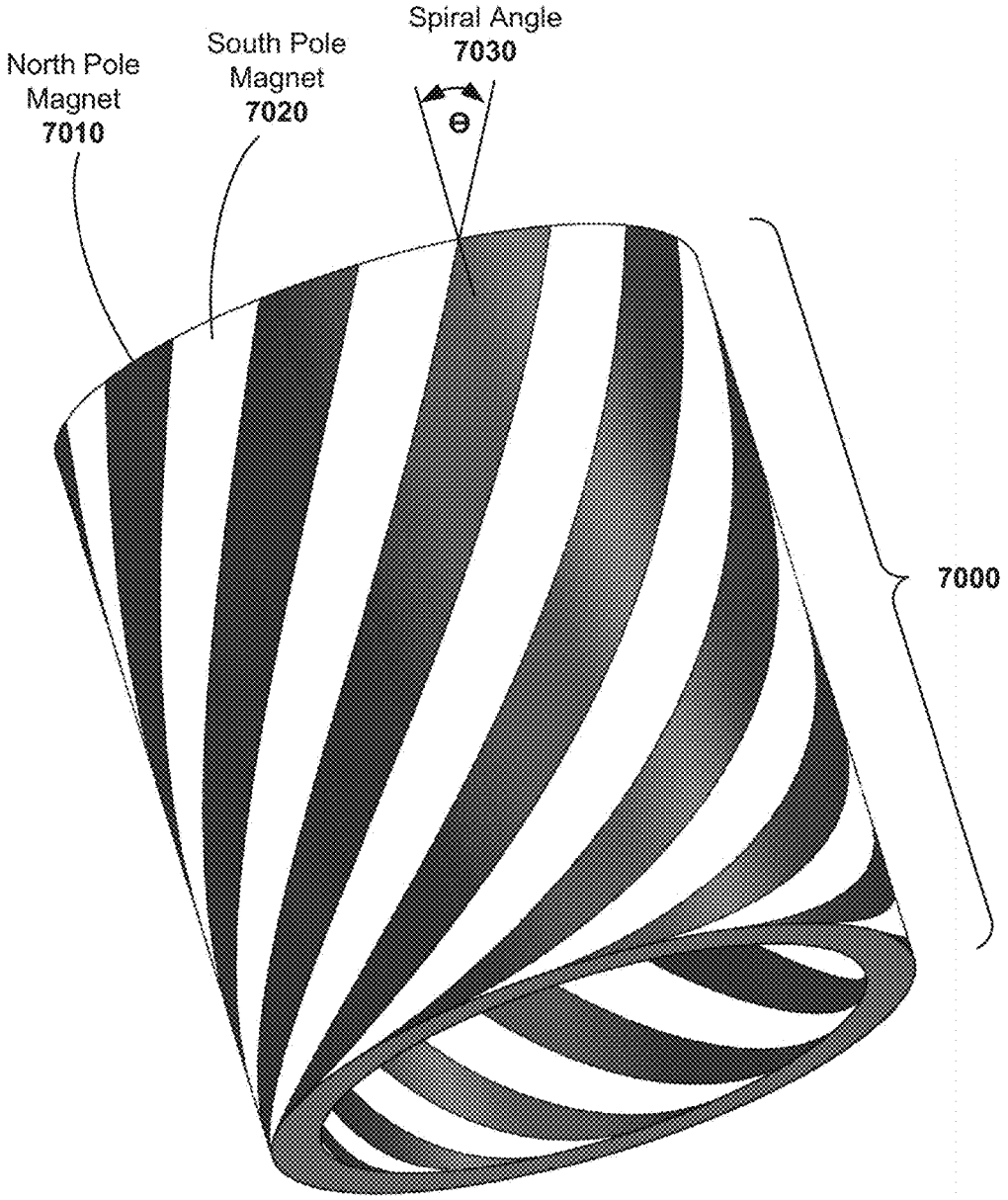
FIG. 7 illustrates magnetic components configured with a progressive spiral path in accordance with an exemplary embodiment.

With reference now to FIG. 7, in various exemplary embodiments, magnetic array 7000 is configured with magnets 7010, 7020 in a progressive spiral pattern of increasing pitch along the axial length of the filter. The initial pitch angle is shown as 7030. For example, near the intake of the filter where fluid velocity is greatest, magnetic array 7000 is configured with a first pitch angle 7030. Further along the filter body where fluid velocity is lower, magnetic array 7000 is configured with a second, higher pitch, for example a progressively higher pitch. In this manner, particulates can experience a longer path under the influence of magnetic array 7000 than would be possible in a spiral of constant pitch, increasing particulate capture effectiveness. Magnetic array 7000 may be configured with any suitable number of turns along the axial length of the filter. In magnetic array 7000, magnets 7010, 7020 may be of similar dimensions.

Figure 8A:
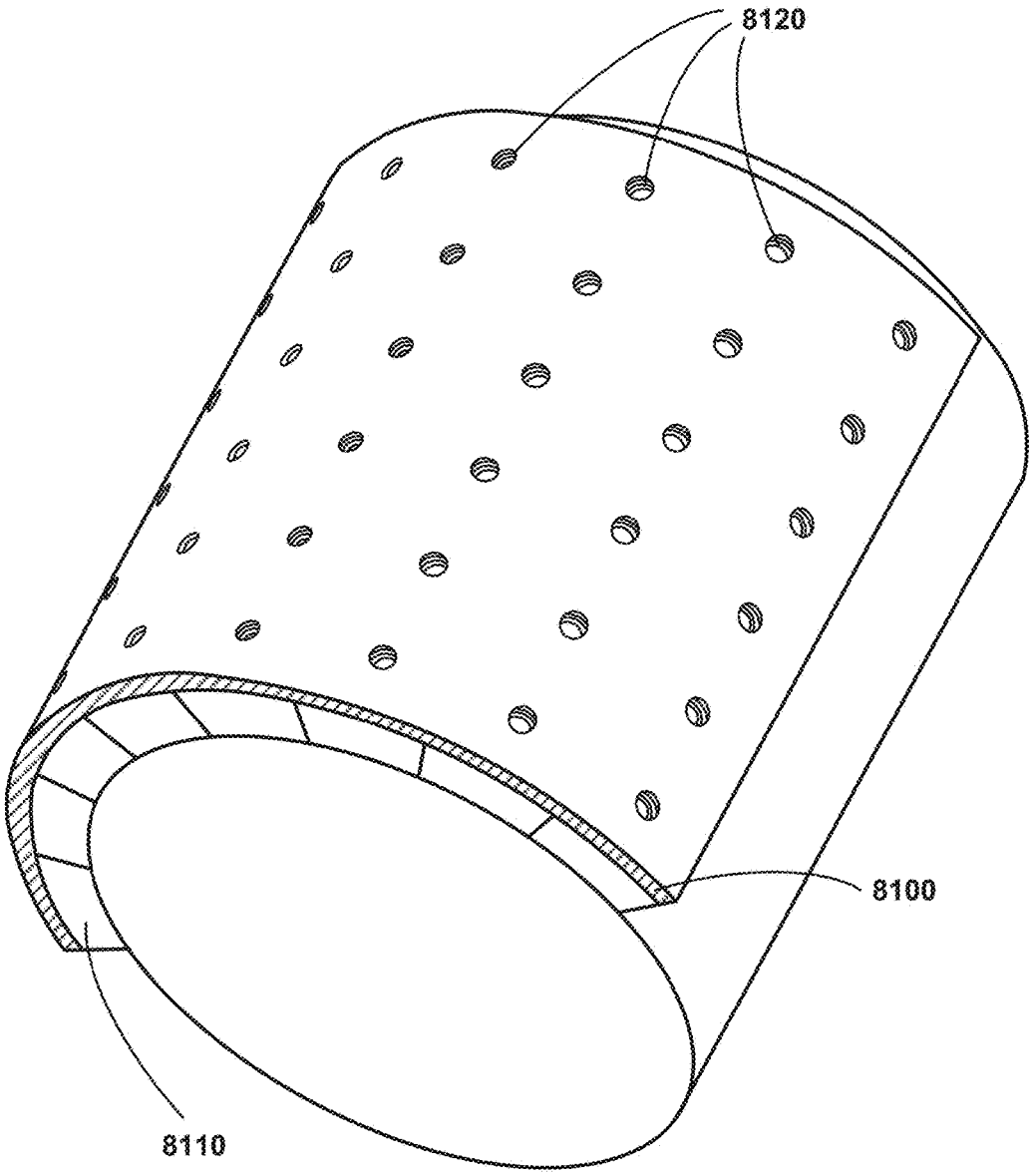
FIG. 8A illustrates components forming a return path suitable for use with exemplary magnetic filter systems in accordance with an exemplary embodiment.

Turning now to FIG. 8A, in various exemplary embodiments, in a magnetic filter system the flux return path and/or structural component that holds the magnetic array may comprise a semi-rigid material composite structure. This structure may comprise multiple cylindrical sheet metal parts 8100. The material may be chosen to have a combination of high magnetic saturation flux and low resistance to magnetic field or high permeability, low cost, appropriate spring constant, and workability.

In various exemplary embodiments, flux return path cylindrical parts may be generated with an array of holes 8120 aligned with the holes in the magnets, for example as illustrated in FIGS. 2A and 5A. This spring material allows for variability of can diameter that a particular array may suitably fit.

Figure 8B:
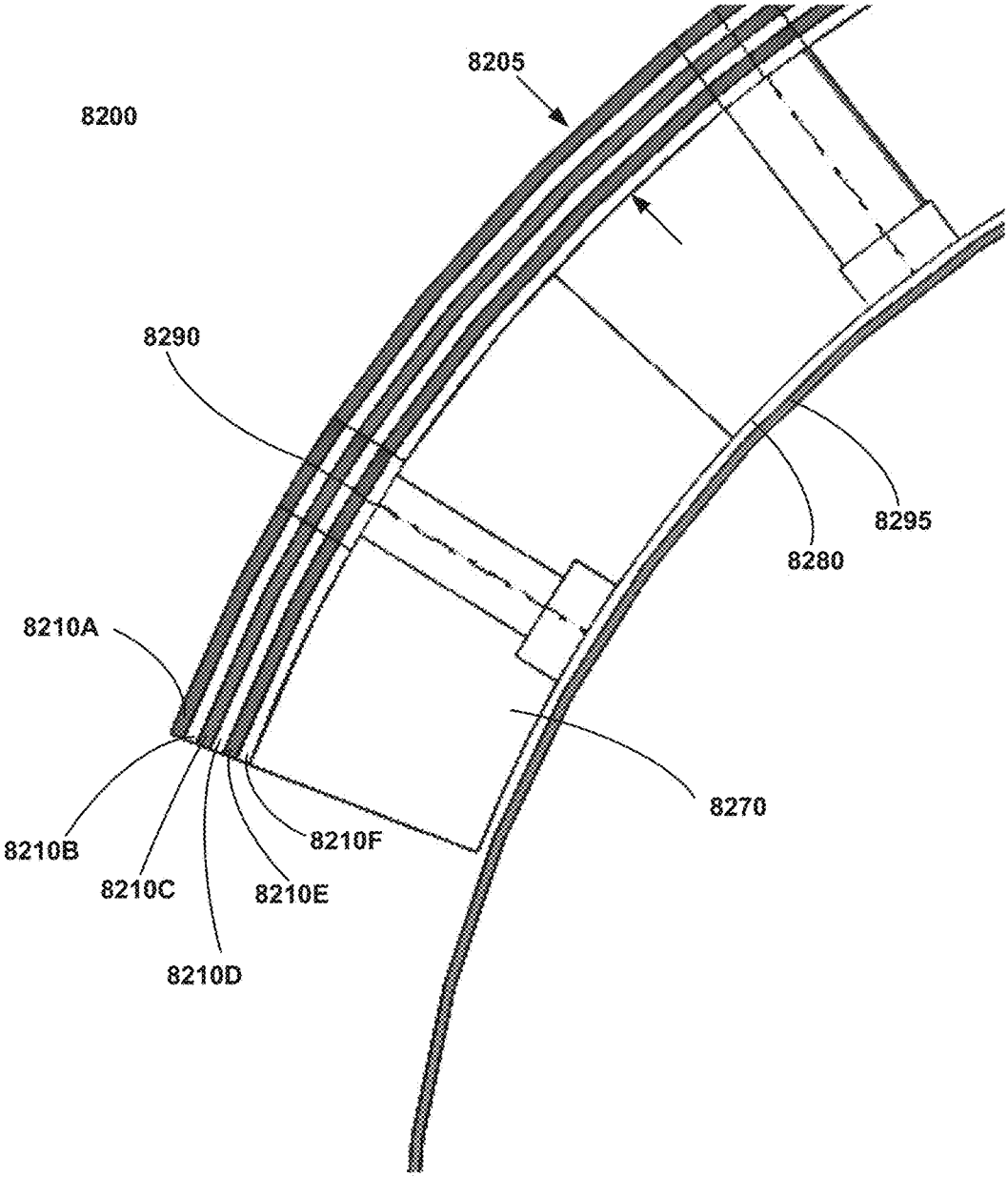
FIG. 8B illustrates exemplary return flux elements of a magnetic filter system in accordance with an exemplary embodiment.

Turning now to FIG. 8B (a cross section view of an exemplary magnetic filter system assembly) in various exemplary embodiments a magnetic filter system 8200 may be configured with hole(s) 8290. Hole 8290 is configured to hold a screw with a wave washer, which together enable a magnetic array to be flexible and self-adjust for the best fit possible upon affixing of the magnetic array to a filter can. It will be appreciated that other suitable fasteners may also be utilized. Also shown in FIG. 8B are magnets 8270 and 8280 designed for a tight fit to the filter can 8295.

In various exemplary embodiments, a return path may comprise several cylindrical sheets, for example steel plates 8210 (e.g., 8210A, 8210B, 8210C, 8210D, 8210E, 8210F) of material chosen to efficiently conduct magnetic flux. Steel plates 8210A through 8210F are configured to be flexible in order to facilitate coupling and decoupling of a magnetic array (comprising magnets 8270, 8280) to a filter, enable the filter to fit a range of filter can sizes, and/or adjust to the manufacturing tolerance of filter cans. In certain exemplary embodiments, each steel plate 8210 is configured with a thickness determined by a bending strength of the composite magnetic return flux element. Moreover, by using a suitably thin sheet material, but a larger number of sheets, a flexibility suitable to allow the magnetics to seat tightly and completely on the filter can and for the flux return path sheets to be attracted and seated to the individual magnets is achieved. The quality of seating may be evaluated by carefully measuring front magnet field strength. Flux return component 8205 may be configured with any suitable number of steel plates 8210. In various exemplary embodiments, flux return component 8205 comprises as few as two steel plates 8210 or up to as many as 24 steel plates 8210 for example. In one exemplary embodiment, flux return component 8205 comprises six steel plates 8210A through 8210F.

Steel plates 8210 may comprise similar materials; alternatively, steel plates 8210 may differ in materials from one another. In certain exemplary embodiments, the steel plate(s) 8210 disposed closest to magnets 8270, 8280 (for example, steel plates 8210F and 8210E illustrated in FIG. 8B) may be formed from a first material having a high saturation (for example, 1018 low carbon steel having a saturation of 20 Kilogauss, Hyperloy having a saturation of 25 Kilogauss, and/or the like). Steel plates 8210 disposed further away from magnet 8270, 8280 (for example, steel plates 8210A through 8210D illustrated in FIG. 8B) may be formed from a second material having a high permeability μ, for example a relative permeability ($\mu/\mu_0$) in excess of 1,000. Any suitable combination of high-saturation and/or high-permeability layers may be employed, as desired, in order to increase the magnetic field gradient formed by magnetic filter system 8200 within an oil filter and/or to reduce flux leakage. Moreover, steel plates 8210 may be configured in a gradient-like fashion for one or more materials characteristics, for example whereby an innermost steel plate 8210 has the highest saturation (and/or lowest relative permeability) of all the steel plates 8210 in magnetic filter system 8200, the next steel plate 8210 has the second-highest saturation (and/or second-lowest relative permeability), and so forth.

In various exemplary embodiments, magnetic filter system 8200 is configured with a sufficient number of steel plates 8210 in order to fully short the magnetic field emanating from magnets 8270, 8280 on the non-filtering side of the magnets. Moreover, steel plates 8210 may be configured to be sufficiently flexible such that, responsive to the force between of magnets 8270, 8280, steel plates 8210, and/or filter can 8295, the components may deform and/or compress to reduce and/or eliminate voids therebetween.

Figure 8C:
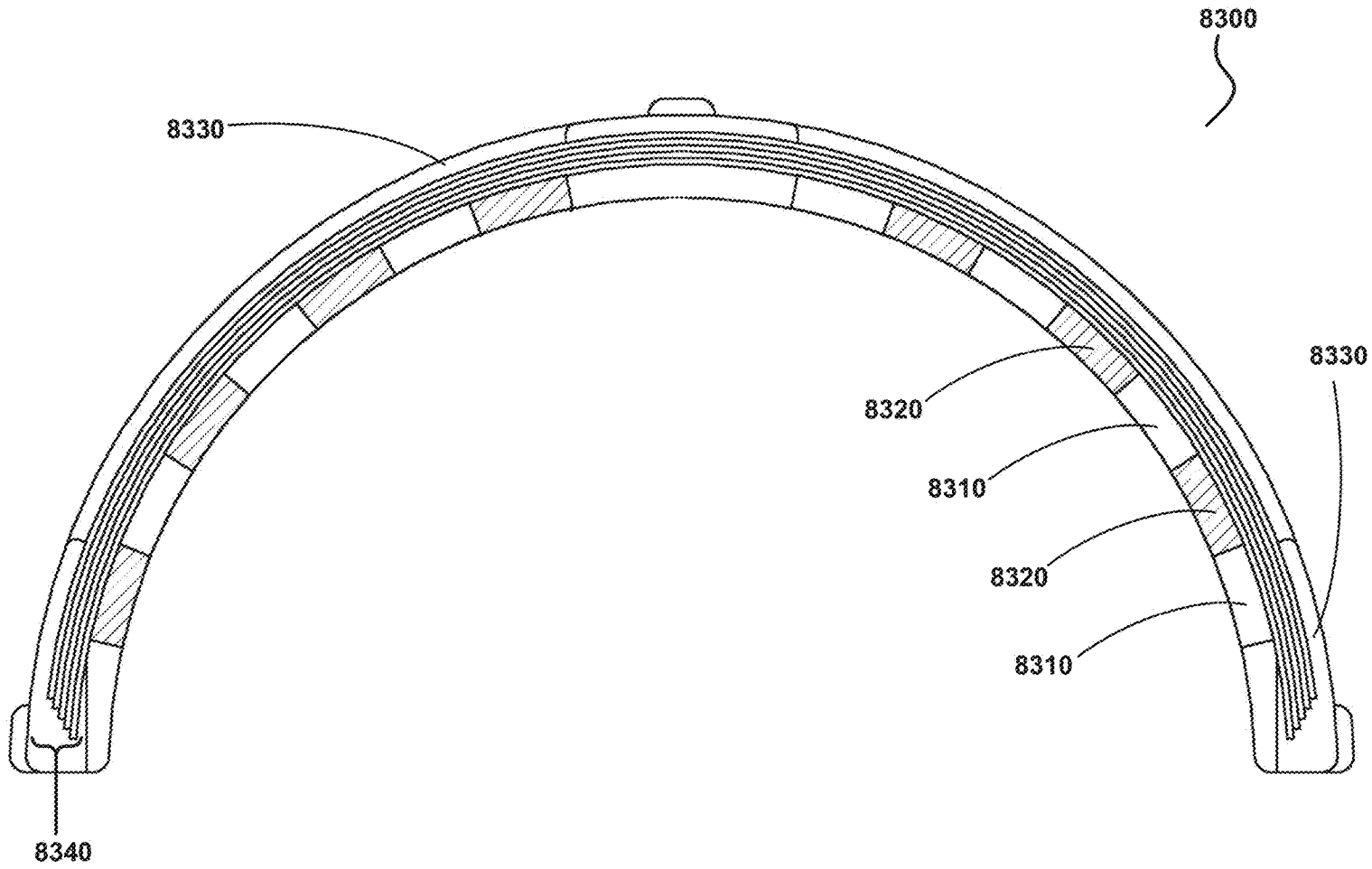
FIG. 8C illustrates structural components of an exemplary magnetic filter system in accordance with an exemplary embodiment.

Turning now to FIG. 8C, illustrated is a cross section of exemplary magnetic filter system 8300 comprising an exemplary structural component 8330, magnets 8310 and 8320, and steel plates 8340. Structural component 8330 may comprise an oil-resistant thermoplastic or other suitable material. In an exemplary embodiment, structural component 8330 comprises a polyamide such as Zytel 718, Zytel 714, or Nylon 6/6 offered by DuPont Performance Polymers. In various exemplary embodiments, structural component 8330 is configured to be thermally stable under operating conditions, for example automotive operating conditions. Structural component 8330 may be moderately flexible, for example in order to facilitate coupling and/or decoupling of magnetic filter system 8300 to a filter can. Removal of exemplary magnetic filter systems from even thin filter cans can be challenging if the magnetic filter system generates enough magnetic force to generate any significant ferromagnetic particle removal.

Figure 9:
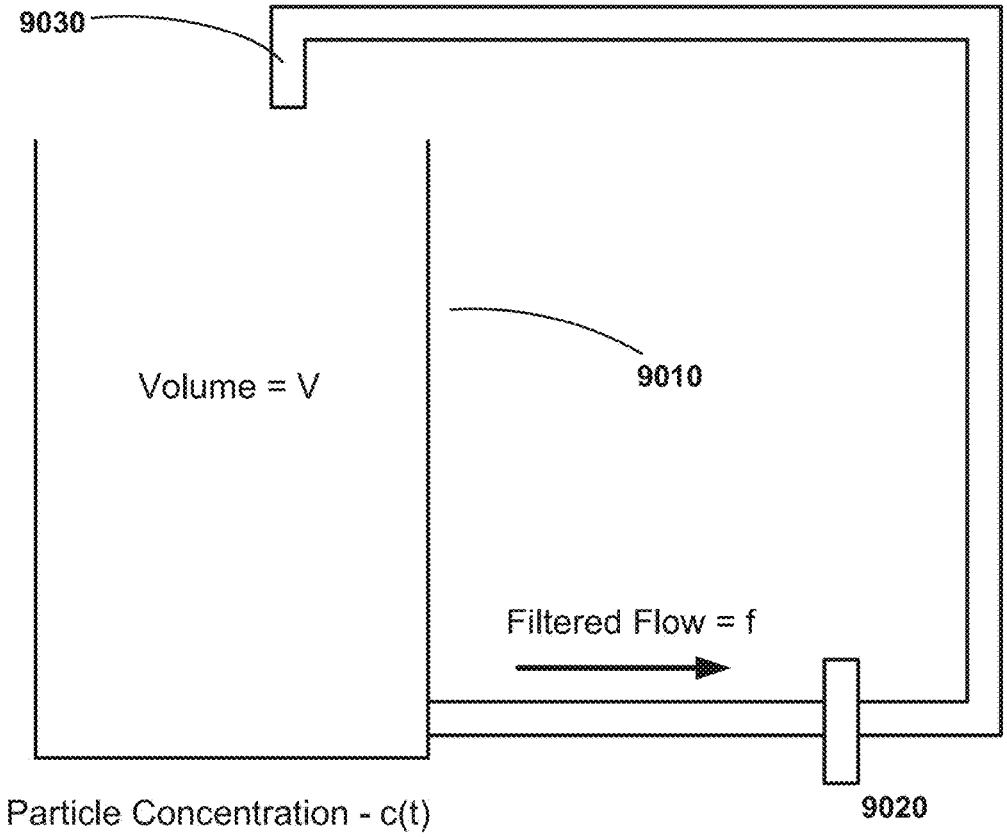
FIG. 9 illustrates a model of a filtration system to measure filtration efficiency in accordance with an exemplary embodiment.

In accordance with principles of the present disclosure, FIG. 9 illustrates a simplified model of a filtration system to measure filtration efficiency. A tank 9010 is pumped through a filter 9020 and then the filtered fluid 9030 is returned to tank 9010. The concentration is described by the formula:

$$c(t) = c_0 e^{-\frac{fa}{V}t}$$

where f is the flow rate, V is the system volume, a is the efficiency of filter 9020 at the size of a particular particle of measurement, and t is time.

A common method to measure the effectiveness of a filter is usually expressed as "beta". As used herein "beta" equals the particle density upstream of the filter divided by the particle density downstream of the filter. Efficiency (a) is related to beta in the following formula: a=1−(1/beta).

Data reduction may be accomplished by fitting the particle density measurement with time to an exponential decay.

TABLE 1

| | Degrees of Filter Circumference Covered by | ISO Size Range | | |
|---|---|---|---|---|
| Configuration | Magnetic filter | 4-6 | 6-14 | 14-21 |
| No magnets | na | 36.9% | 77.5% | 95.1% |
| Linear CT4.9 | 340 | 57.1% | 78.7% | 84.7% |
| Linear SRW | 340 | 75.1% | 90.1% | 94.1% |
| Checkerboard SRW | 340 | 70.0% | 91.7% | 98.5% |

Table 1 shows the results of a no magnets CT4.9 linear array, linear array SRW, and checkerboard SRW array of magnets comparing 340-degree magnetic coverage. "SRW" arrays are arrays designed according to principles of the present disclosure. The data is defined by methods, rather than an ISO defined particle size. In the ISO standards, the 4 micron column is all particles≥4 microns, 6 micron is all particles≥6 microns, 14 micron is all particles≥14 microns, and 21 microns is all particles≥21 microns. ISO data may be transformed into bins to aid in intuitive understanding of exemplary data as follows: The 4-6 column is defined as particles≤4 microns diameter and <6 microns diameter, the 6-14 column is defined as particles≥6 microns and <14 microns, and the 14-21 column is defined as ≥14 microns and <21 microns.

Figure 10:
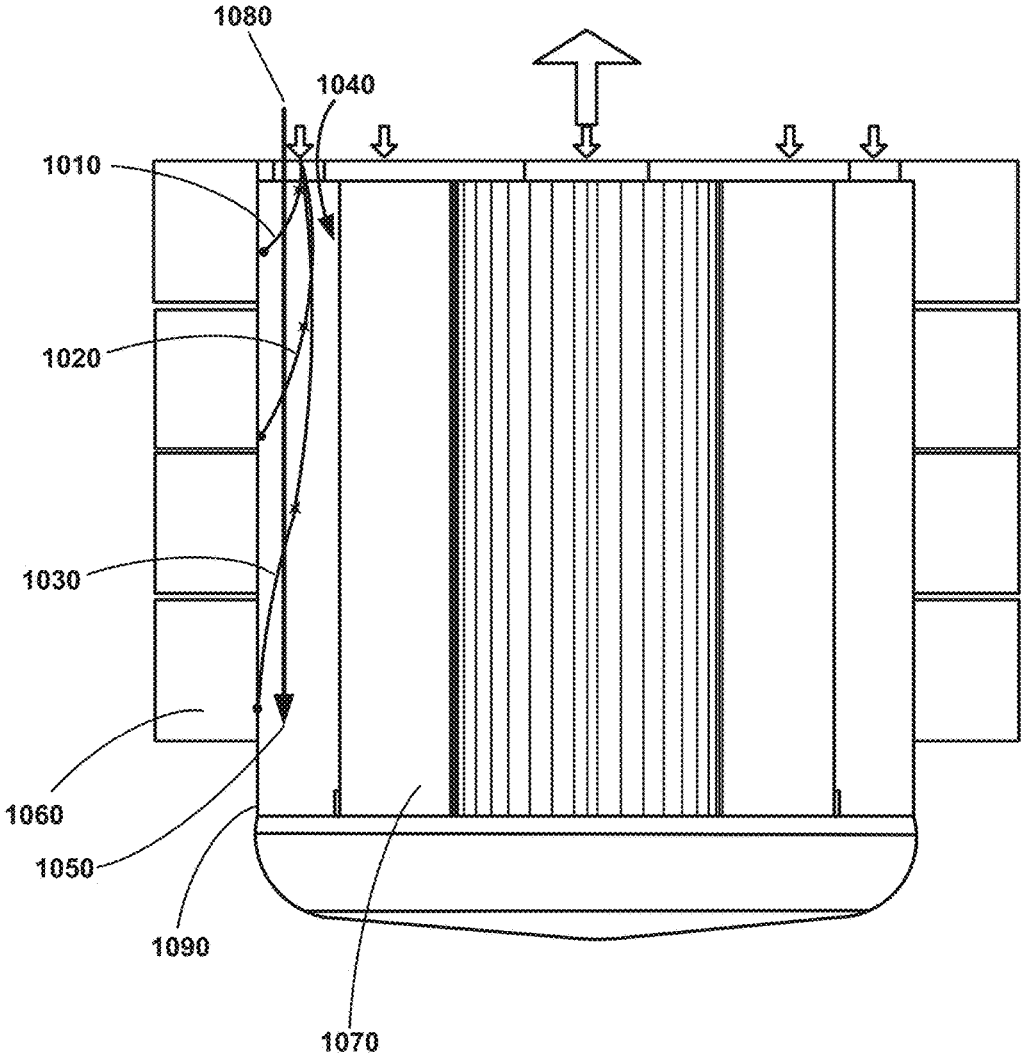
FIG. 10 illustrates differences in the path of certain ferrous particles by size in accordance with an exemplary embodiment.

Turning now to FIG. 10, a simplified difference in paths of ferrous particles by size is illustrated. Since the magnetic force is lower on the smaller particles, the smaller particles take longer to reach the filter wall. An exemplary path of a large particle is described by arc 1010, and an exemplary path of a smaller particle is described by arc 1020. An exemplary path of a yet smaller particle is described by arc 1030. This simplified understanding is made more complex due to the fact that injection 1080 through the holes in the top is not a uniform laminar flow injection, i.e., an injection devoid of turbulence.

In various exemplary embodiments, flow streams 1040 injected near filter element 1070 have a starting distance from the can wall 1090 that is larger than the flow streams near the wall. This means that particles that enter the filter near the flow stream 1040 are the hardest to trap by the magnetic field generated by magnets 1060, and are most likely to make it through the filter untrapped. The flow stream 1050 shows a flow stream near the filter wall 1090. This leads to a particle path 1030 that is the path of the smallest particle that is trapped.

As flow stream 1050 moves down the annular region between the filter element and the filter can wall, the flow is slowing along the axial length due to flow passing through the filter element. This reduced velocity improves the trapping efficiency of the magnetic field.

Figure 11:
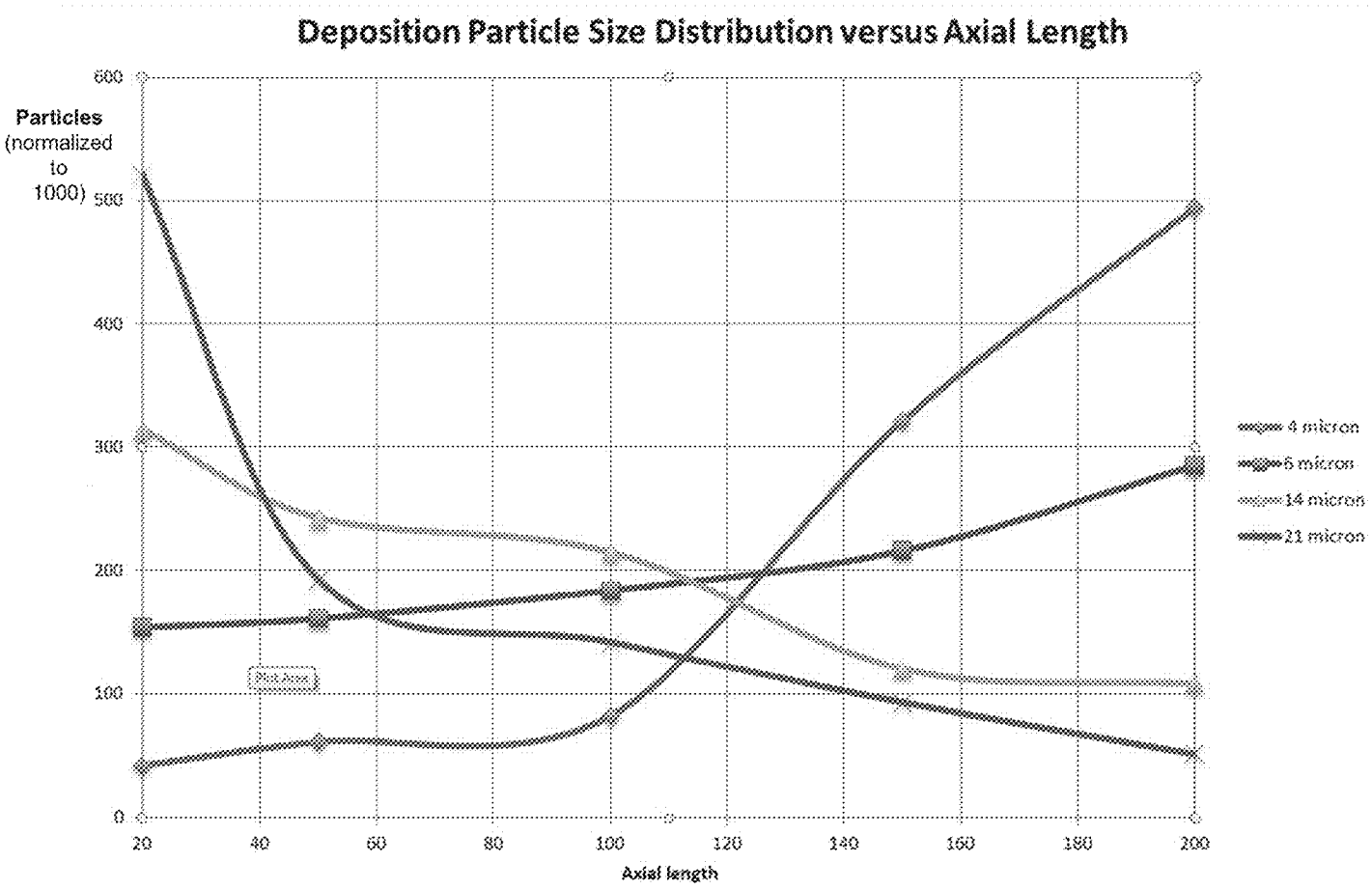
FIG. 11 shows modeled graphical data on particle size versus axial position of deposition in accordance with an exemplary embodiment.

In various exemplary embodiments, FIG. 11 shows modeled graphical data on particle size versus axial position of deposition. Additionally, to characterize performance of exemplary magnetic filter systems configured in accordance with principles of the present disclosure, a used filter was carefully removed, cut open and samples taken along the wall. The resulting measurements are normalized to 1000 particles of each size. The distribution varies with length along the axis. Samples were taken at 5 locations on the wall of a filter that had operated over many runs with an exemplary magnetic filter system attached to the filter. Data from each sample was measured and compared for size distribution. The data confirms that larger particles are trapped at higher rates near the flow entry end of the filter, and smaller particles are trapped with higher ratios compared to the larger particles at the end of the filter away from the inlet of the oil flow. Accordingly, principles of the present disclosure contemplate desirable configurations of axially long filters and corresponding long magnetic assemblies for efficient filtering.

TABLE 2

Particle Size Distribution of Wall Deposited Particles

| Axial position | ISO Size Bin | | | |
|---|---|---|---|---|
| mm | 4 | 6 | 14 | 21 |
| 20 | 42 | 154 | 314 | 521 |
| 50 | 61 | 161 | 243 | 193 |
| 100 | 82 | 184 | 215 | 142 |
| 150 | 321 | 216 | 120 | 93 |
| 200 | 494 | 285 | 108 | 51 |

Table 2 shows the particle size distribution versus axial position data of FIG. 11 in tabular form.

Figure 12:
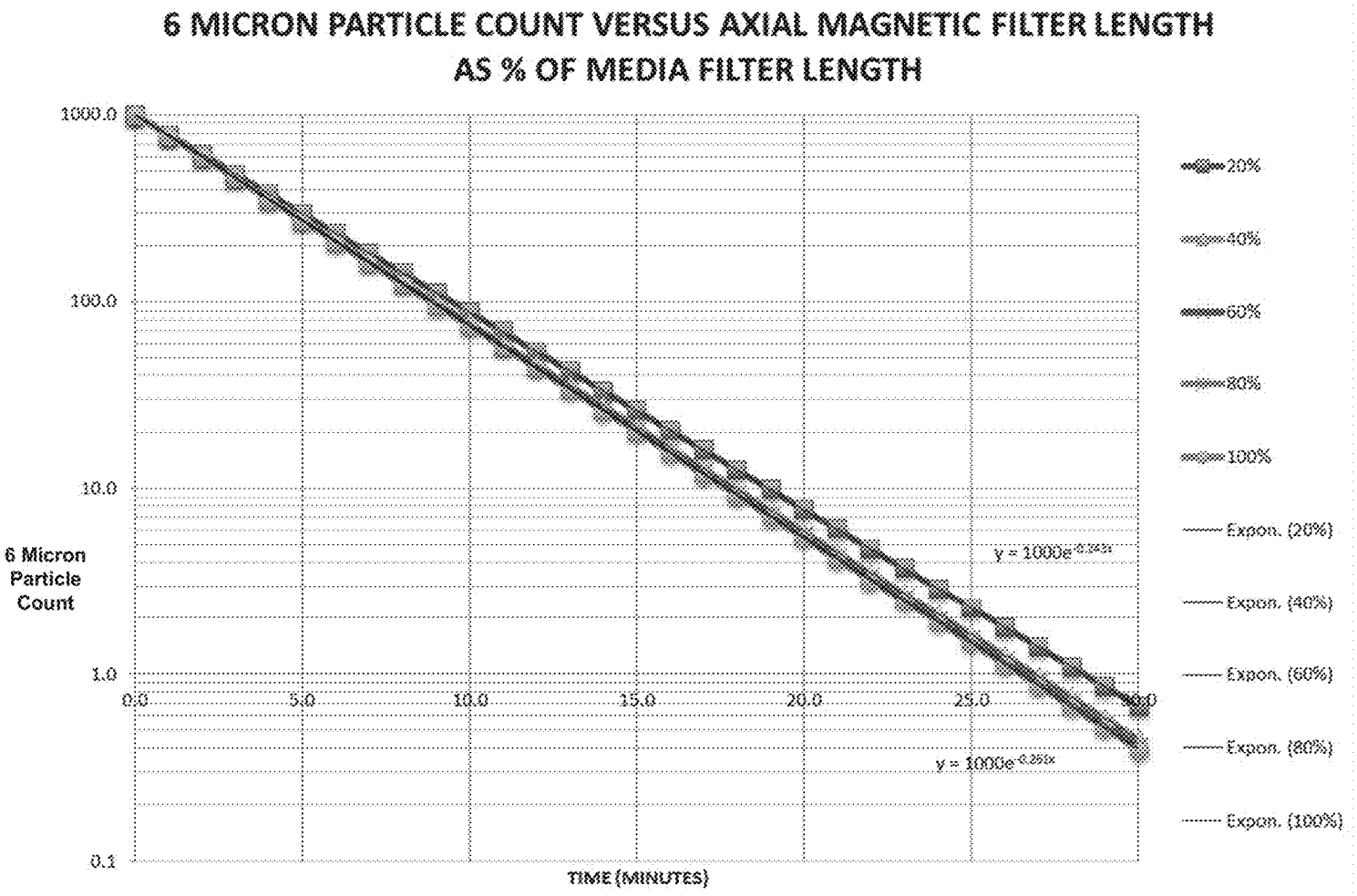
FIG. 12 illustrates exemplary modeled filtration results comparing a 20, 40, 60, 80, and 100% length of filter coverage in accordance with an exemplary embodiment.

With reference now to FIG. 12, exemplary filtration results of exemplary magnetic filter systems are shown, comparing a 20, 40, 60, 80, and 100% axial length coverage magnetic filter system as indicated by the legend of the graph. All data is normalized to 1000 particles to ease comparison of various particle size capture efficiency. When graphed on a semi-log plot, an exponential decay of particle density is a straight line. Fitting programs are used to improve data accuracy. This accuracy is desirable because, as illustrated in FIG. 12, the curves are close to each other and may desirably be separated by fitting.

FIG. 13 shows a summary of the modeled data of FIG. 12 in tabular form. This tabular form is derived from the fitted data on the graph of FIG. 12. These curves are almost indistinguishable by visual inspection of the graph but easily differentiated by curve fitting.

In summary and, in light of the foregoing discussion, it will be appreciated that many current designs of magnetic filters are lacking in the amount of magnet material used (for example, due to cost), and/or are designed with narrow magnets that provide a magnetic force on particles that is adequate to extend the magnetic field*magnetic gradient product only a very short distance inside the filter can wall. In contrast, exemplary magnetic filter systems configured in accordance with principles of the present disclosure are capable of obtaining high efficiency capture of ferrous particles over large cross section of the filter flow.

In an exemplary embodiment, a magnetic filter system comprises a magnetic component comprising a series of magnets of alternating polarity interleaved in a checkerboard pattern, and a flux return component comprising at least one flexible steel plate. The magnets in the magnetic component may be configured with a height H and an inner width IW, and each magnet in the series of magnets may be configured with the height H between 40% and 60% of the inner width IW. When an oil filter is coupled to the magnetic filter system, the magnetic component may cause a magnetic gradient*magnetic field product of at least ((0.1 Tesla/mm)*1 Tesla) to arise in a portion of the volume between the filter wall and the filter media. The magnetic component may be configured with a magnetic border length in excess of 1.25 units of length per unit of area.

In an exemplary embodiment, a magnetic filter system comprises a magnetic component having an array of magnets configured with at least one of a linear pattern, ring pattern, spiral pattern, or progressive spiral pattern. The magnetic filter system may comprise at least one flexible steel plate or other flux conducting structure. The magnetic filter system may also comprise a physical structure that maintains the array of magnets. The array of magnets may comprise sections that fit together and enable assembly and/or removal, for example by reducing the attractive force on a section to enable a section to be safely moved by human hands.

In another exemplary embodiment, a magnetic filter system comprises a magnetic component comprising a series of magnets of alternating polarity interleaved in a spiral pattern, and a flux return component comprising at least one flexible steel plate. The spiral may have a pitch of between about 90 degrees over the axial length of the filter to about n*360 degrees over the axial length of the filter. The spiral pattern may continuously increase in pitch with axial length of the magnetic filter system. The spiral pattern may be configured with piecewise pitch changes, for example with a first pitch over a first portion of the magnetic filter system and with a second, greater pitch over a second portion of the magnetic filter system. The flux return component may comprise a first steel plate and a second steel plate, and the first steel plate may be disposed between the series of magnets and the second steel plate. The first steel plate may have a higher saturation than the second steel plate. The second steel plate may have a higher relative permeability than the first steel plate. When an oil filter is coupled to the magnetic filter system, the spiral pattern may cause a ferromagnetic particulate in the oil filter to travel a distance along a magnetic border, wherein the distance is greater than the axial length of the oil filter.

In another exemplary embodiment, a magnetic filter system comprises a magnetic component comprising a first section and a second section. In the first section, a first series of alternating polarity magnets are interleaved in a first pattern, and in the second section, a second series of alternating polarity magnets are interleaved in a second pattern different than the first pattern. The magnetic filter system may comprise a flux return component comprising at least one flexible steel plate.

In another exemplary embodiment, a magnetic filter system comprises a magnetic component comprising an interleaved series of magnets of alternating polarity, and a flux return component comprising at least one flexible steel plate. When the magnetic filter system is coupled to an oil filter, the interleaved series of magnets extends along 100% of the axial length of the oil filter, and a magnetic border in the magnetic component extends continuously along the axial length of the oil filter.

In yet another exemplary embodiment, a magnetic filter system comprises a magnetic component comprising a series of magnets of alternating polarity, the magnetic component configured in an arctuate shape to facilitate coupling to an oil filter, and a flux return component comprising at least one flexible steel plate, the flux return component coupled to the magnetic component along the outer side of the arc. When the magnetic filter system is coupled to an oil filter, the magnetic component results in a flow coverage ratio of at least 50% in the oil filter. The magnetic component may result in a flow coverage ratio of 100% in a ring-shaped volume within the oil filter element.

In yet another exemplary embodiment, a magnetic filter system comprises an arctuate magnetic component comprising a series of magnets of alternating polarity, and a flux return component comprising at least one flexible steel plate, the flux return component coupled to the magnetic component along the outer side of the arc. When the magnetic filter system is coupled to an oil filter, the magnetic component results in a magnetic field gradient of 0.1 Tesla/mm and a magnetic field density in excess of 0.5 Tesla at location in the oil along a magnetic border and 3 mm away from the filter wall.

In yet another exemplary embodiment, a method of using a magnetic filter system comprises coupling a magnetic filter system to an oil filter, wherein the magnetic filter system comprises a series of magnets of alternating polarity interleaved in a checkerboard pattern, and a flux return component comprising at least one flexible steel plate. The method may further comprise operating an engine to cause oil to flow through the oil filter, wherein the oil flow delivers particulates in the oil to be deposited against the outer wall of the filter responsive to a magnetic field*magnetic gradient product generated by the magnetic filter system.

While the principles of this disclosure have been shown in various embodiments, many modifications of structure, arrangements, proportions, the elements, materials and components, used in practice, which are particularly adapted for a specific environment and operating requirements may be used without departing from the principles and scope of this disclosure. These and other changes or modifications are intended to be included within the scope of the present disclosure and may be expressed in the following claims.

The present disclosure has been described with reference to various embodiments. However, one of ordinary skill in the art appreciates that various modifications and changes can be made without departing from the scope of the present disclosure. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element of any or all the claims.

As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "coupled," "coupling," or any other variation thereof, are intended to cover a physical connection, an electrical connection, a magnetic connection, an optical connection, a communicative connection, a functional connection, and/or any other connection. When language similar to "at least one of A, B, or C" or "at least one of A, B, and C" is used in the claims, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. A magnetic filter assembly, comprising:

a structural frame having a mounting cavity;

a flux return plate disposed within the mounting cavity; and a magnetic component comprising an interleaved series of permanent magnets of alternating polarity, wherein, when the magnetic filter assembly is coupled to a cylindrical oil filter, the interleaved series of permanent magnets extends along 100% of the axial length of the cylindrical oil filter, and a magnetic border in the magnetic component extends continuously along the axial length of the cylindrical oil filter.

2. The magnetic filter assembly of claim 1, wherein the interleaved series of permanent magnets is configured with at least one of a checkerboard pattern, a spiral pattern, a stretcher bond pattern, a raking stretcher bond pattern, or a monk bond pattern.

3. The magnetic filter assembly of claim 1, wherein the magnetic component is configured in the shape of a partial cylinder.

4. The magnetic filter assembly of claim 1, wherein each permanent magnet in the interleaved series of permanent magnets is characterized by a magnet length dimensioned along the longitudinal axis of a partial cylinder, a magnet inner width dimensioned along the circular arc of the partial cylinder, and a magnet height dimensioned parallel to a magnetic axis of each permanent magnet, and wherein, for each permanent magnet, the ratio of the magnet inner width to the radius of the circular arc is between 0.3 and 0.5, and the ratio of the magnet height to the magnet inner width is between 0.3 and 0.6.

5. The magnetic filter assembly of claim 4, wherein, for each permanent magnet in the interleaved series of permanent magnets, the ratio of the magnet inner width to the radius of the circular arc is between 0.3 and 0.4, and wherein, for each permanent magnet in the interleaved series of permanent magnets, the ratio of the magnet height to the magnet inner width is between 0.45 and 0.55.

6. The magnetic filter assembly of claim 1, wherein, when an oil filter comprising an oil filter media disposed within an oil filter wall is coupled to the magnetic filter assembly, the magnetic component causes a magnetic gradient*magnetic field product of at least ((0.1 Tesla/mm)*1 Tesla) to arise in a portion of an oil filter volume between the oil filter wall and the oil filter media.

7. The magnetic filter assembly of claim 1, wherein the interleaved series of permanent magnets of alternating polarity are oriented such that a magnetic axis of each permanent magnet is perpendicular to the flux return plate.

8. The magnetic filter assembly of claim 1, wherein the flux return plate comprises a first steel plate and a second steel plate, and wherein the first steel plate is disposed between the interleaved series of permanent magnets of alternating polarity and the second steel plate.

9. The magnetic filter assembly of claim 8, wherein the first steel plate comprises a material having a higher saturation than the material comprising the second steel plate, and wherein the second steel plate comprises a material having a higher relative permeability than the material comprising the first steel plate.

10. The magnetic filter assembly of claim 1, wherein the magnetic component is configured with a magnetic border length in excess of 1.25 units of length per unit of area.

11. The magnetic filter assembly of claim 1, wherein, when the magnetic filter assembly is coupled to an oil filter, the magnetic component results in a flow coverage ratio of at least 50% in the oil filter.

* * * * *